US009716948B2

(12) United States Patent
Tang

(10) Patent No.: US 9,716,948 B2
(45) Date of Patent: Jul. 25, 2017

(54) AUDIO MIXING METHOD AND SYSTEM

(71) Applicant: 9D Technologies Company Limited, Hong Kong (HK)

(72) Inventor: Hong Si Junno Tang, Hong Kong (HK)

(73) Assignee: 9D TECHNOLOGIES COMPANY LIMITED, Hong Kong (HK)

( * ) Notice: Subject to any disclaimer, the term of this patent is extended or adjusted under 35 U.S.C. 154(b) by 193 days.

(21) Appl. No.: 14/793,753

(22) Filed: Jul. 8, 2015

(65) Prior Publication Data

US 2016/0014516 A1 Jan. 14, 2016

Related U.S. Application Data

(60) Provisional application No. 62/022,653, filed on Jul. 9, 2014.

(51) Int. Cl.
*H04R 5/04* (2006.01)
*H04R 5/02* (2006.01)

(52) U.S. Cl.
CPC ..... *H04R 5/04* (2013.01); *H04R 5/02* (2013.01)

(58) Field of Classification Search
None
See application file for complete search history.

(56) References Cited

U.S. PATENT DOCUMENTS

2010/0272270 A1* 10/2010 Chaikin ..... H04R 29/008 381/59

FOREIGN PATENT DOCUMENTS

| | | | |
|---|---|---|---|
| CN | 102780951 | A | 11/2012 |
| CN | 103024634 | A | 4/2013 |
| CN | 103686544 | A | 3/2014 |

OTHER PUBLICATIONS

Search Report of counterpart Hong Kong Short-term Application No. 15105611.1 issued by the Chinese Patent Office on Jul. 10, 2015.
Search Report issued by the Chinese Patent Office on Sep. 23, 2014.

* cited by examiner

*Primary Examiner* — Paul Huber

(57) ABSTRACT

The present application discloses an audio mixing method and system for audio mixing on original sound signals. The method includes: arranging a plurality of loudspeaker boxes according to predetermined positions to form a predetermined acoustic space, the predetermined acoustic space including a plurality of predetermined acoustic positions; and arranging, at predetermined acoustic positions in the predetermined acoustic space, sound track elements of each sound track among one or more sound tracks based on a predetermined rule. The present application provides an audio mixing method and system that implement subtle acoustic effects and provide better user experience.

9 Claims, 21 Drawing Sheets

For Examsle : A (Treble, position2)--->S (Alto, position8)--->U(Bass, position6)

AUDIO MIXING METHOD AND SYSTEM

CROSS-REFERENCE TO RELATED APPLICATIONS

This application claims the benefit of U.S. Provisional Patent Application No. 62/022,653, filed Jul. 9, 2014, the entire content of which is hereby incorporated by reference.

BACKGROUND

Technical Field

The present application relates to an audio mixing technology, and in particular, to an audio mixing method and system.

Related Art

Audio mixing is a step in music production, which integrates sounds from multiple sources into one musical work. Original sound signals for audio mixing may come from different musical instruments, human voices or orchestral music. During audio mixing, a mixing engineer will adjust an audio parameter of each original sound signal, to optimize each sound track, and then the sound tracks are superimposed on a final work. This processing manner can produce a hierarchical audio effect that the common audience cannot hear during live recording.

SUMMARY

The present application is directed to an audio mixing method for audio mixing on original sound signals, including: arranging a plurality of loudspeaker boxes according to predetermined positions to form a predetermined acoustic space, the predetermined acoustic space comprising a plurality of predetermined acoustic positions; and arranging, at the predetermined acoustic positions in the predetermined acoustic space, sound track elements of each sound track among one or more sound tracks based on a predetermined rule.

The predetermined acoustic space may include nine acoustic positions divided based on a nine-patch pattern having three lines and three columns; a left-front loudspeaker box, a centre loudspeaker box, a right-front loudspeaker box, a left-rear loudspeaker box and a right-rear loudspeaker box are separately arranged at line 1, column 1 of the nine-patch pattern, line 1, column 2 of the nine-patch pattern, line 1, column 3 of the nine-patch pattern, line 3, column 1 of the nine-patch pattern, and line 3, column 3 of the nine-patch pattern; a first mixed acoustic effect may be achieved by the left-rear loudspeaker box and the right-rear loudspeaker box with equal levels for playback to form a first virtual loudspeaker box located at line 3, column 2 in terms of acoustic perception of a listener sitting at a central position at line 2, column 2; a second mixed acoustic effect may be achieved by the left-front loudspeaker box and the left-rear loudspeaker box with equal levels for playback to form a second virtual loudspeaker box located at line 2, column 1 in terms of the acoustic perception of the listener; a third mixed acoustic effect may be achieved by the right-front loudspeaker box and the right-rear loudspeaker box with equal levels for playback to form a third virtual loudspeaker box located at line 2, column 3 in terms of the acoustic perception of the listener; and a fourth mixed acoustic effect may be achieved by the left-front loudspeaker box, the centre loudspeaker box, the right-front loudspeaker box, the left-rear loudspeaker box, and the right-rear loudspeaker box with equal levels for playback to form a fourth virtual loudspeaker box in terms of the acoustic perception of the listener.

Each of the loudspeaker boxes may include a treble loudspeaker, an alto loudspeaker, and a bass loudspeaker, and each of the sound track elements may be determined to be played by a predetermined loudspeaker in a predetermined loudspeaker box according to the predetermined rule.

The audio mixing method may further include: correcting a monitoring volume and a position of each of the loudspeaker boxes and each of the loudspeakers; and determining an audio parameter of each of the sound track elements.

The audio parameter may include: volume, frequency, and delay, and the audio mixing method further may include: on a same sound track, changing the frequency of a given sound track element to generate sound track elements of different frequencies, or playing the given sound track element for different predetermined numbers of times to generate different delays.

The audio mixing method may further include: producing an audio file used for wired, satellite, IPTV, terrestrial TV, broadcast propagation media; and coding, decoding, converting, and transcoding bit streams of Dolby Digital format, Dolby Digital+ format, Dolby Pulse format, Dolby Atmos format, and Dolby E format, and making a final file support PCM, MPEG-1 LII, AAC, HE AAC, and HE AAC v.2.

The audio mixing method may further include: determining a sampling frequency and a quantization bit number of audio digitalization, where a precision may be 24 bit/48 kHz or higher; determining a full scale level of digital audio equipment, dBu of the level may be +24 or higher; performing synchronization processing based on a sampling point; adjusting a frequency, an amplitude, and a phase of the audio in real time; and remedying sound defects, comprising: eliminating ambient noise, wind noise, and current interference noise.

The audio mixing method may further include: performing audio mixing processing based on sound therapy, musical tone therapy, and music therapy, and calculating a mobile sound effect based on psychoacoustics and physics, to form same-frequency music structure, the music structure producing a natural resonance between the viscera and nervous system of a listener and musical notes when the listener listens to the music; and determining a declining extent of a low frequency or an ultra-low frequency of sound during audio mixing production.

The audio mixing may be performed on a lossless WAV file of sound of an edited film clip; an audio-mixed sound track WAV file may be converted into an AC3 file having the following format: 448 Kbps, 48,000 Hz, and 9.1 Surround; the edited film clip may be converted into an MP4 file having the following format: resolution: 1920*1080 HD, mode: VBR (2-pass), and bit rate: 8000 kbps; the MP4+AC3 files are combined into a final audio and video file having the following format: resolution: 1920*1080 HD, mode: constant bit rate (CBR), bit rate: 4000 kbps, and sound mode: CBR, 448 Kbps, 8,000 Hz, and 9.1 Surround.

In another aspect, the present application is directed to an audio mixing system for audio mixing on original sound signals, including: a computing apparatus and a plurality of loudspeaker boxes, wherein the a plurality of loudspeaker boxes are arranged according to predetermined positions to form a predetermined acoustic space; the predetermined acoustic space may include a plurality of predetermined acoustic positions; the computing apparatus arranges, at predetermined acoustic positions in the predetermined acoustic space, sound track elements of each sound track among one or more sound tracks based on a predetermined rule.

DETAILED DESCRIPTION

Audio mixing is a key step for mixing sound tracks into final music. Excellent audio mixing presents people the splendid part of music, so that the music has a perfect playback effect. The present application relates to an audio mixing method and system, which are used to adjust audio parameters such as frequency, dynamic, sound quality, positioning, reverberation, and sound stage of an original sound signal, to achieve a perfect audio mixing effect, so that a listener can enjoy wonderful listening experience.

At the beginning of audio mixing, pure original sound signals should be obtained, that is, it is ensured as far as possible that sound of each track is clean. After the original sound tracks are acquired, frequencies of the sound tracks may be processed, for example, a high-pass filter and a low-pass filter may be used to accurately define a frequency range of each musical instrument.

Then, each element of each sound track needs to be arranged at a predetermined acoustic position in a predetermined acoustic space. The following describes arrangement of the predetermined acoustic position of each element of each sound track of the present application.

Figure 1:
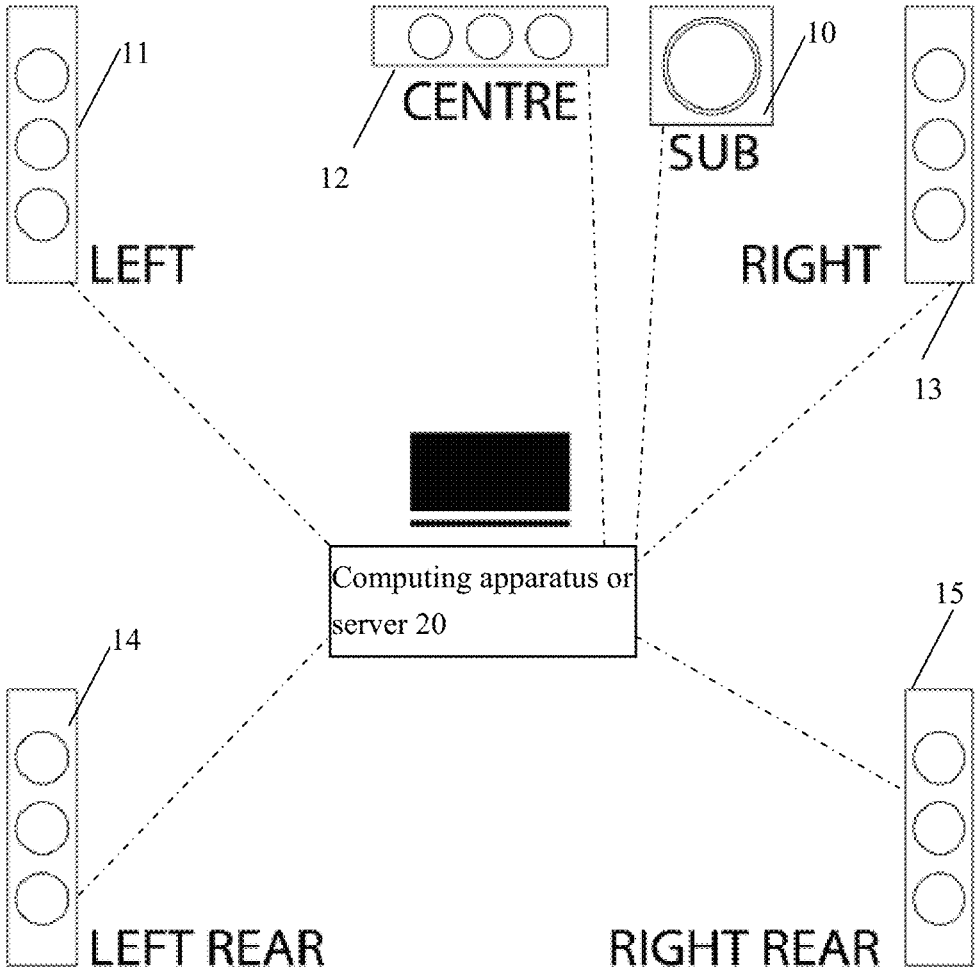
FIG. 1 shows an acoustic space consisting of multiple loudspeaker boxes.

As shown in FIG. 1, a predetermined acoustic space consists of multiple loudspeaker boxes, and is a 5.1 surround stereo sound system. In this acoustic space, a central position is used as a reference position, that is, that a listener can enjoy the best audio effect at the central position is used as a reference. The listener faces a centre loudspeaker box 12, a left loudspeaker box 11 is in left front of the listener, and a right loudspeaker box 13 is in right front of the listener, where a subwoofer 10 is disposed beside the centre loudspeaker box 12, and a left-rear loudspeaker box 14 and a right-rear loudspeaker box 15 are separately disposed on the left and right sides behind the listener. Based on the arrangement of each loudspeaker box, a predetermined acoustic space is formed.

Figure 2:
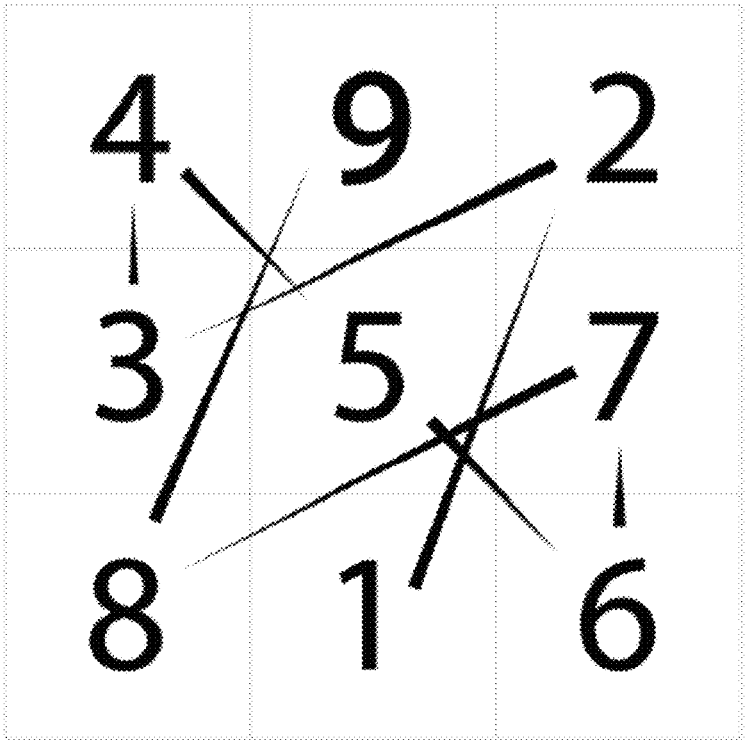
FIG. 2 shows a sound track element hopping mode according to the present application.

In the present application, hopping of a sound track element is changed based on a predetermined rule, so as to produce a mysterious acoustic effect. In this acoustic space, the listener can listen to a musical work composed by using the audio mixing technology (which is referred to as 9D audio mixing herein) of the present application. The listener can not only listen to the wonderful musical work, but also experience a fantastic physical nursing effect. FIG. 2 shows a sound track element hopping mode according to the present application, which is referred to as I Ching hopping mode. In this mode, the acoustic space is divided into nine acoustic positions, namely, position 1 to position 9 shown in the figure, by a traditional Chinese nine-patch pattern.

Figure 3:
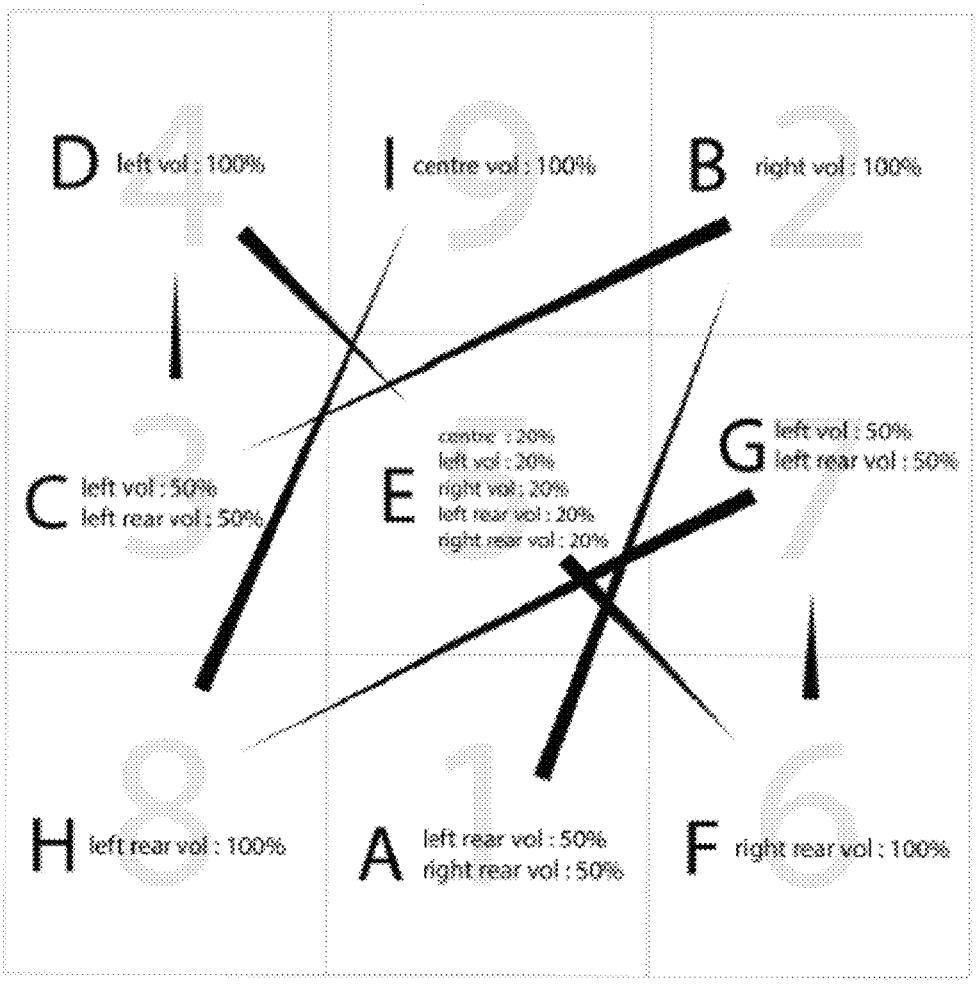
FIG. 3 shows playback of continuous sound track elements at predetermined acoustic positions.

It is assumed that one sound track has nine sound track elements A to G, as shown in FIG. 3, which shows playback of continuous sound track elements at predetermined acoustic positions. Element A is played by the left-rear loudspeaker box 14 and right-rear loudspeaker box 15 with equal levels, and a mixed acoustic effect makes the listener feel, in terms of acoustic experience, as if element A is played at position 1. Then, element B is completely played by the right loudspeaker 13 box, that is, the listener feels, in terms of acoustic experience, as if element B is played at position 2. The rest can be deduced by analogy, where 100% shown in the figure represents that the corresponding sound track element is completely played by the loudspeaker box at the corresponding position, and 0 represents that the loudspeaker box does not produce any sound. 50% represents that two corresponding loudspeaker boxes play the corresponding sound track element with equal levels, while at position 5, the sound track element E is played by the left loudspeaker box 11, the right loudspeaker box 13, the left-rear loudspeaker box 14, the right-rear loudspeaker box 15, and the centre loudspeaker box 12 with equal levels, so that the listener feels, in terms of acoustic experience, as if element E is played at position 5.

Figure 4:
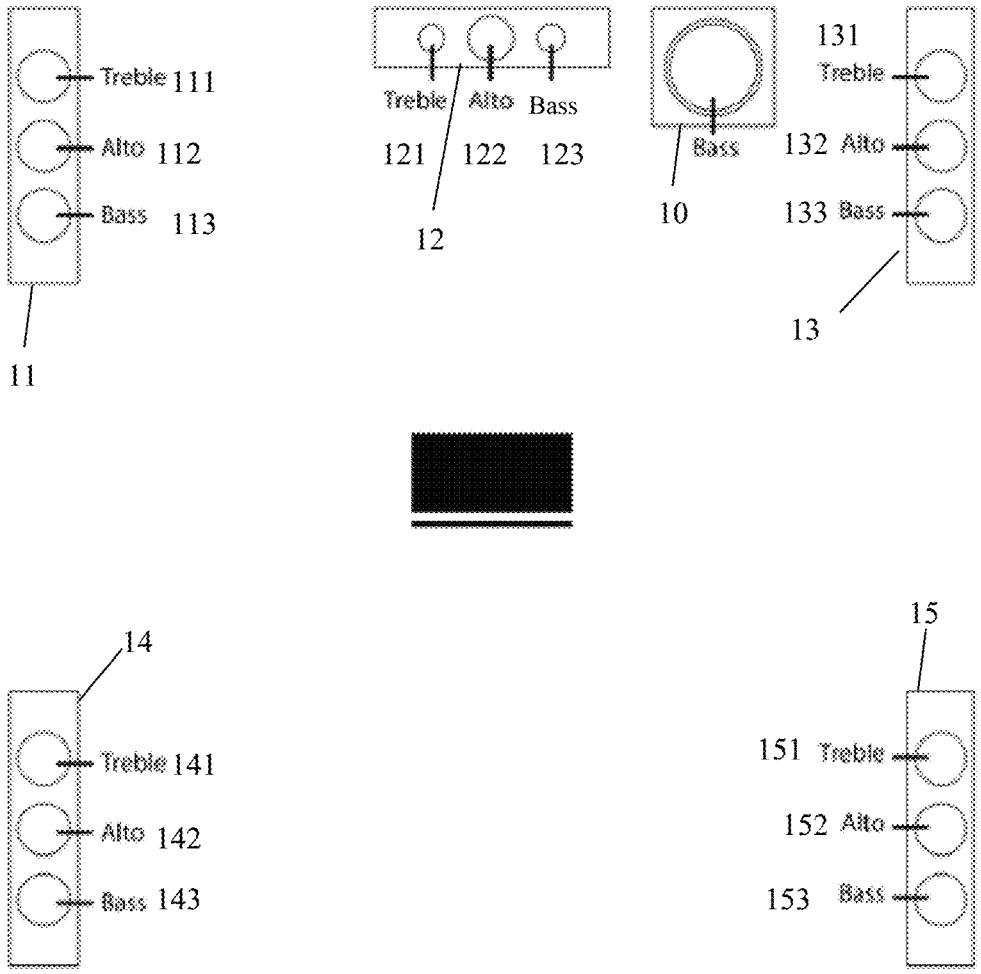
FIG. 4 shows a specific structure of each loudspeaker box in the acoustic space.
Figure 5:
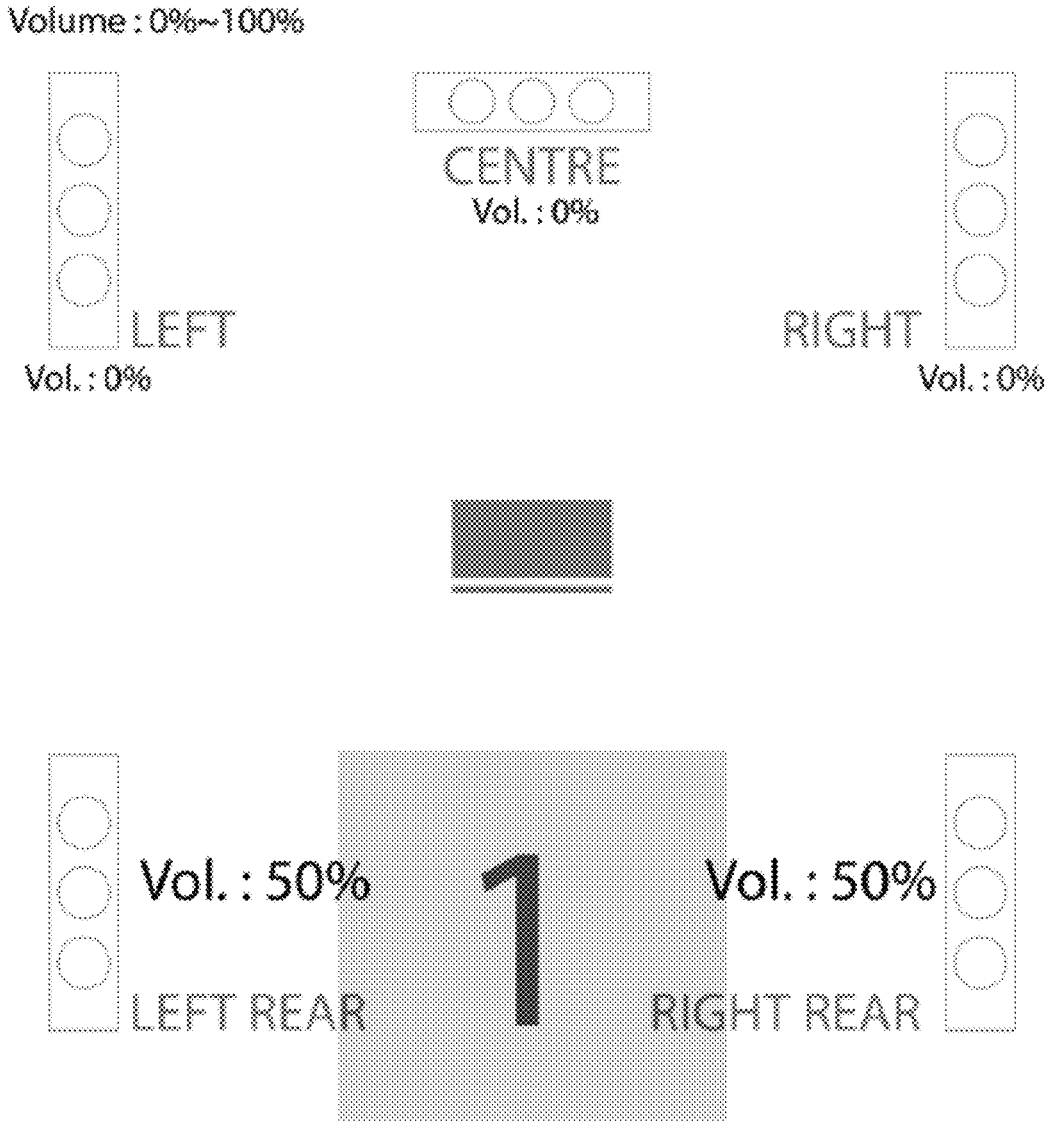
FIG. 5 to FIG. 13 show all acoustic playback positions of nine elements of one sound track in an acoustic space of a nine-patch form.
Figure 6:
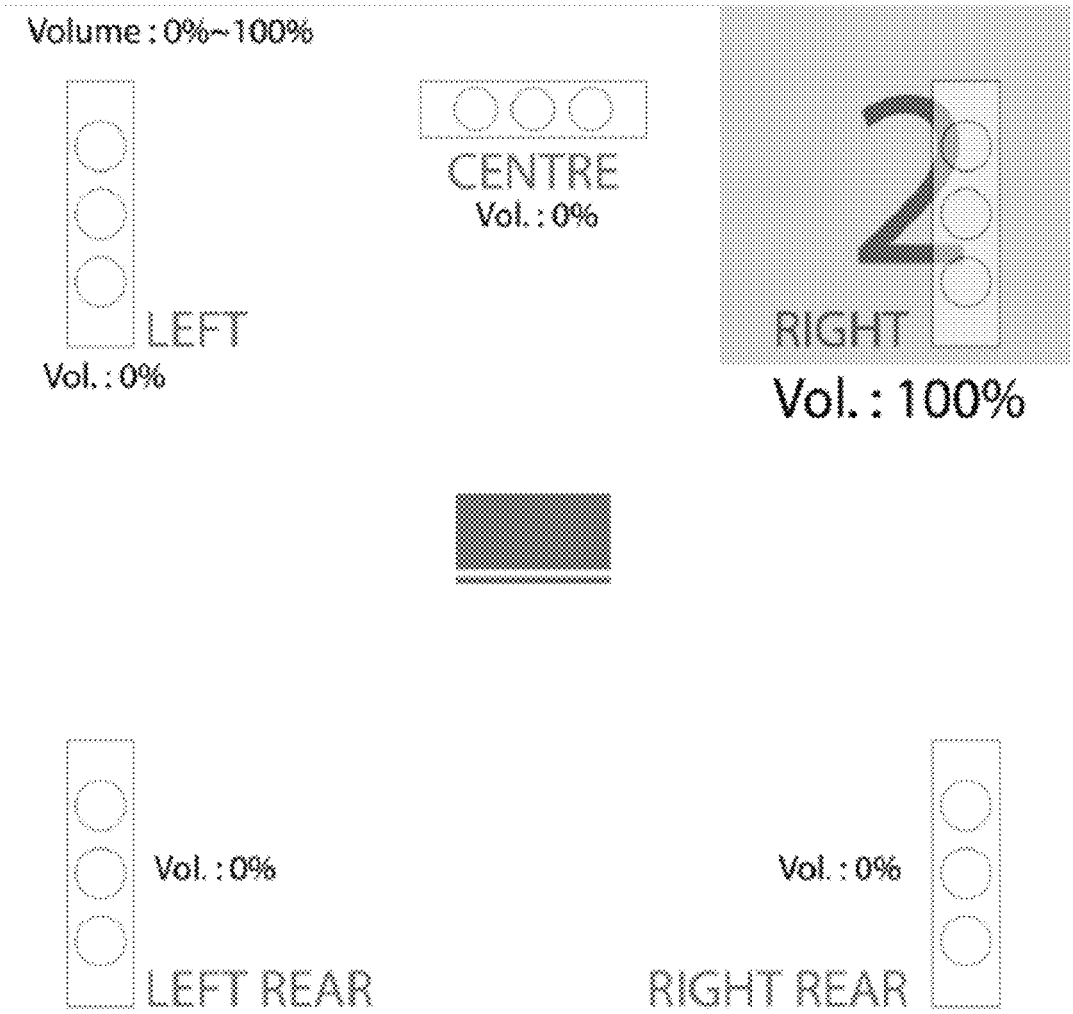
Figure 7:
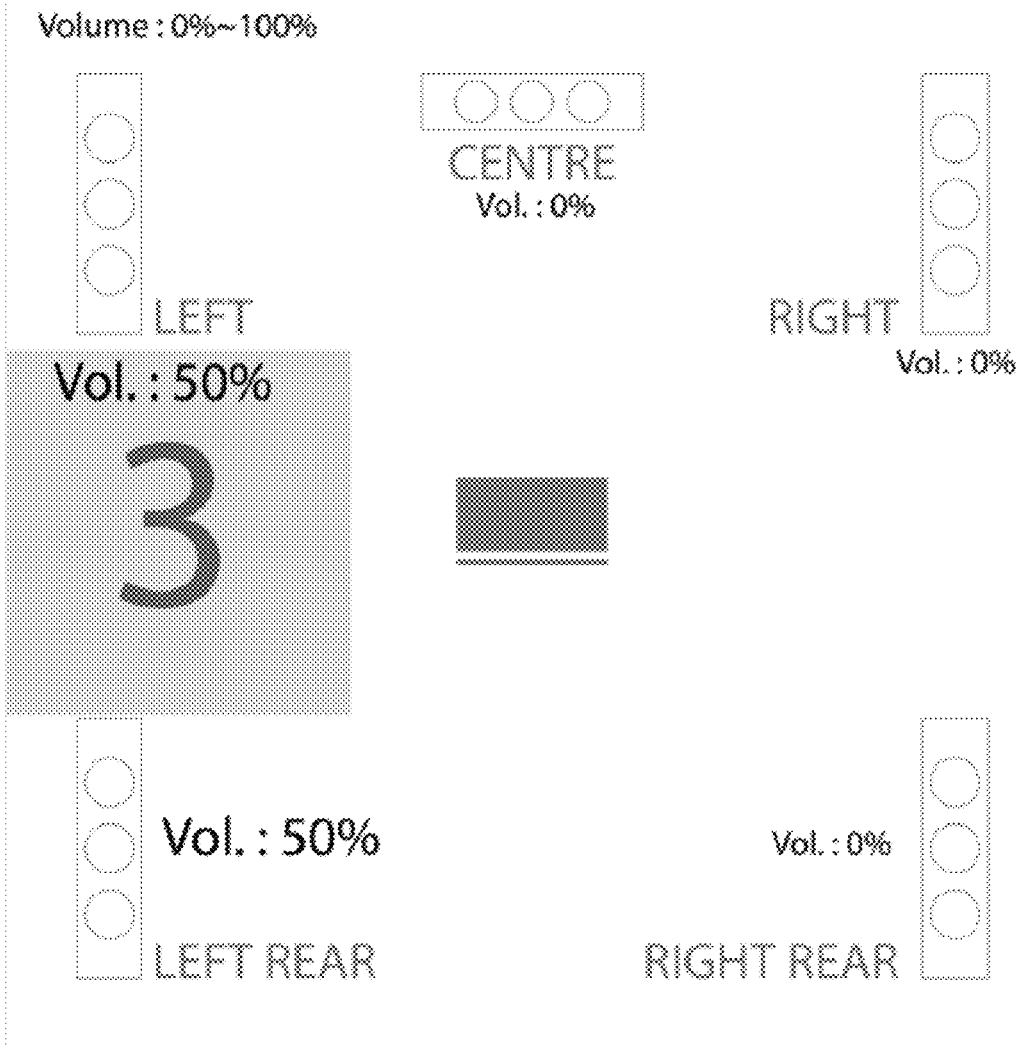
Figure 8:
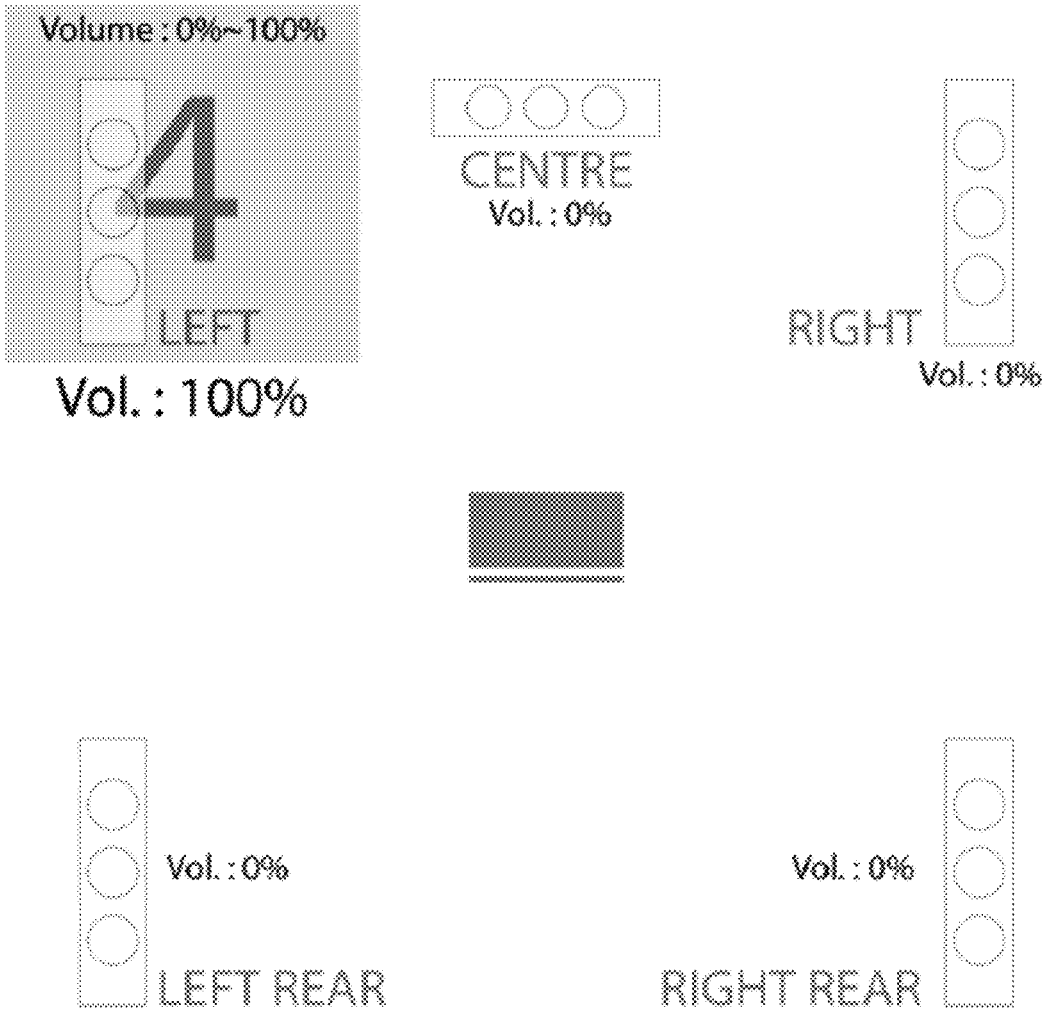
Figure 9:
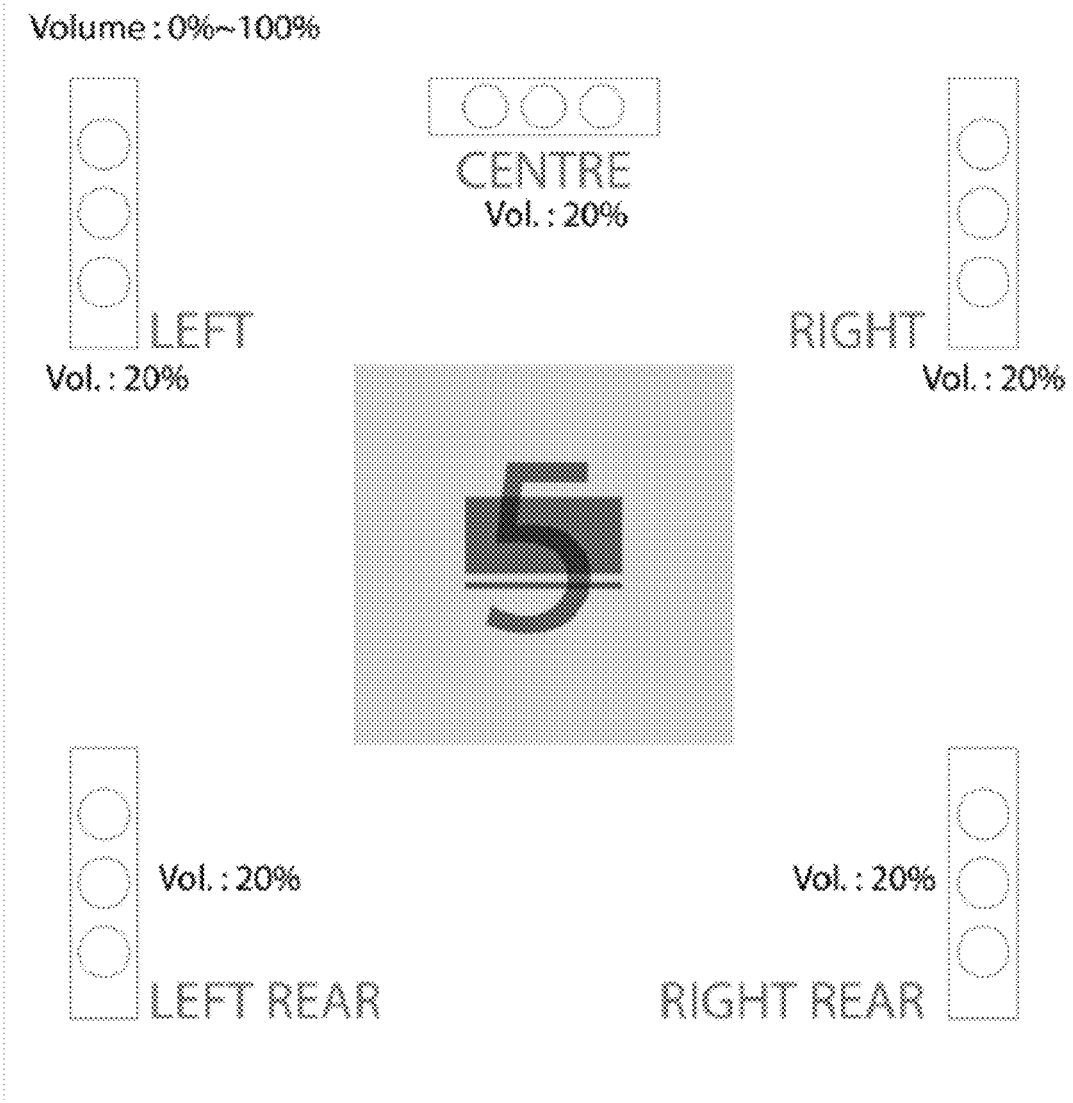
Figure 10:
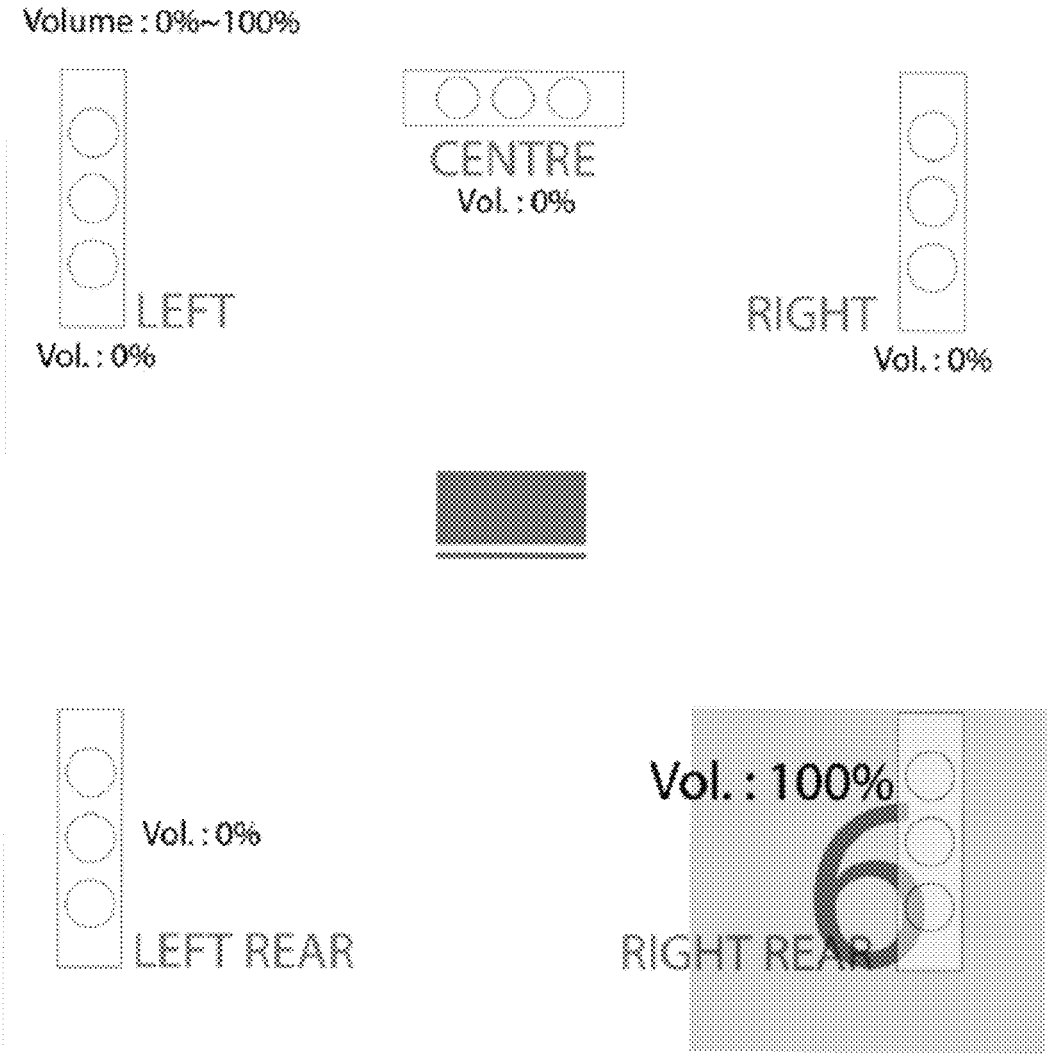
Figure 11:
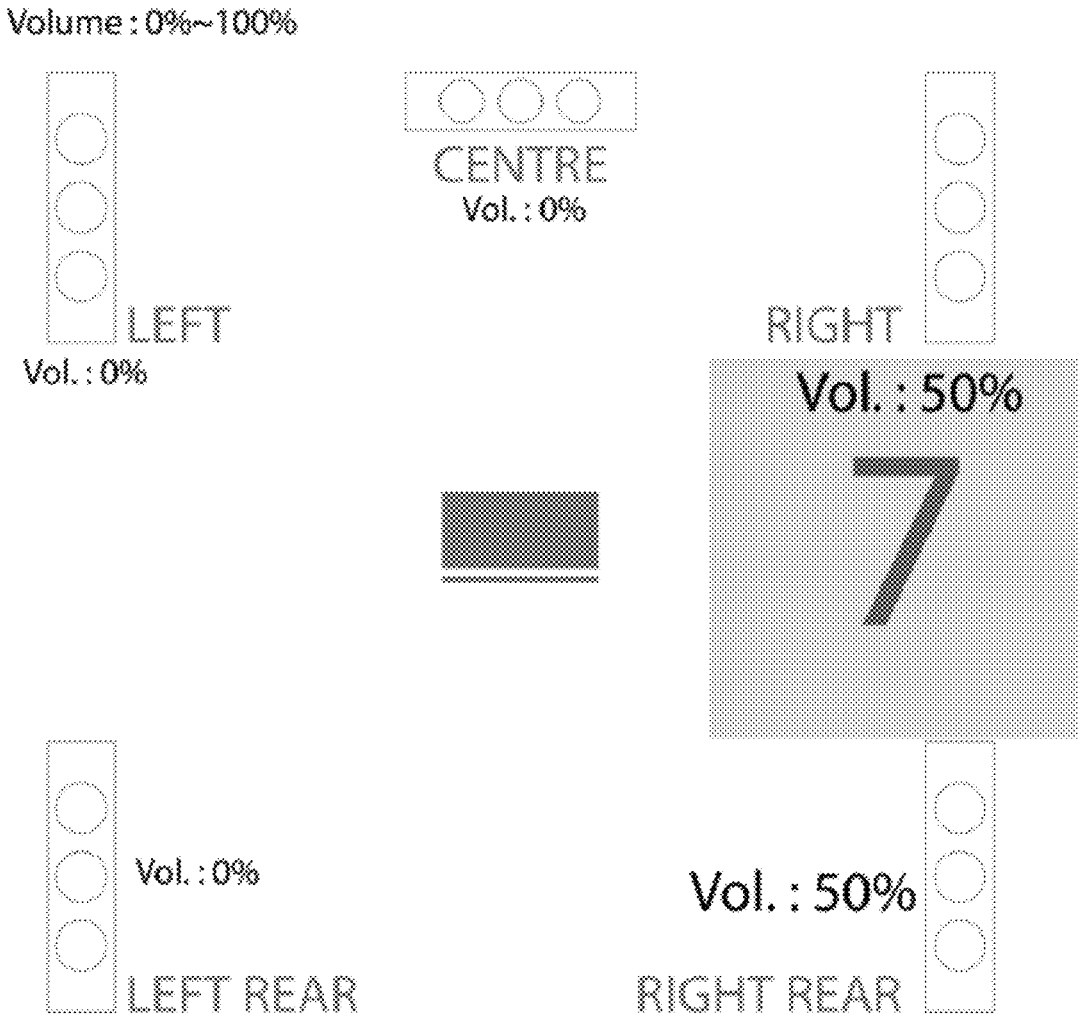
Figure 12:
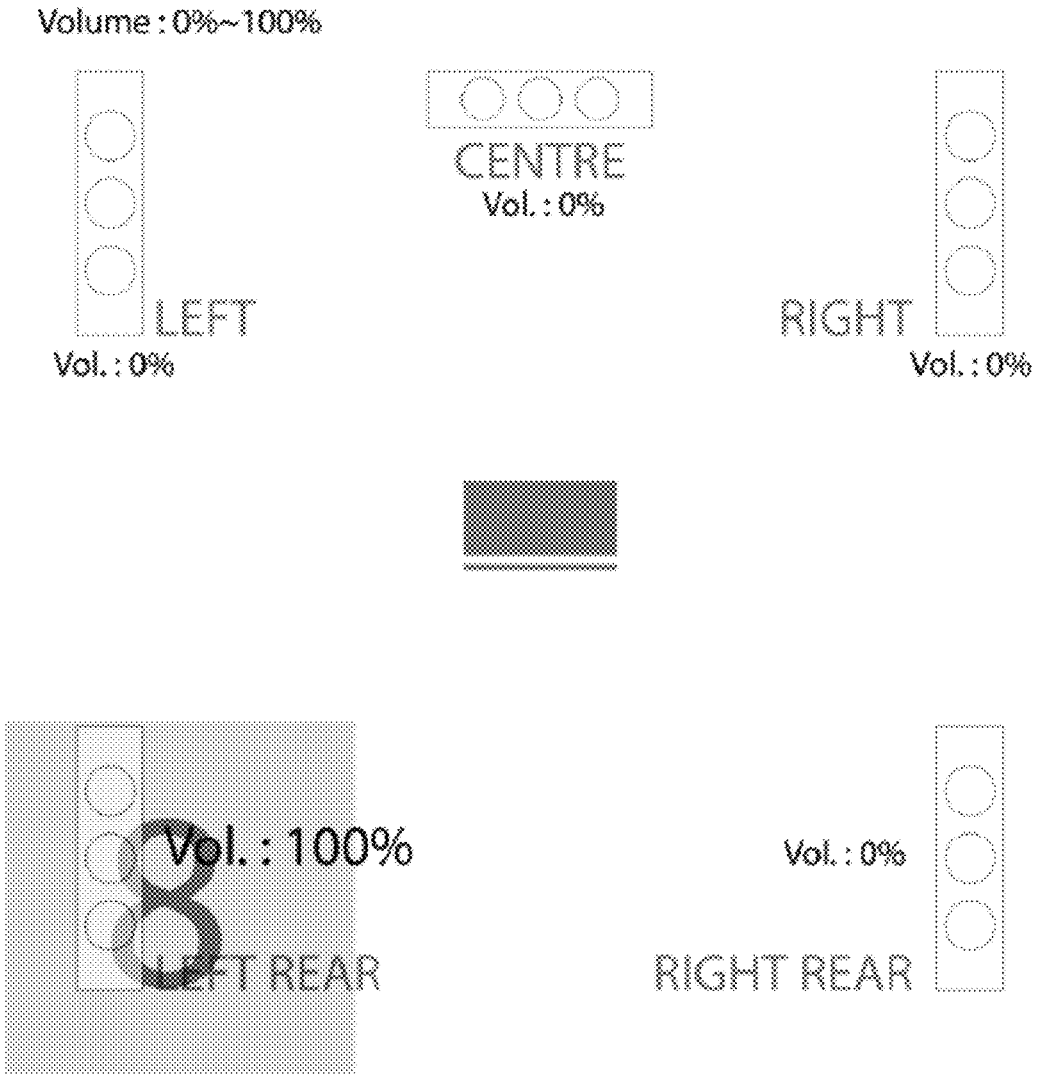
Figure 13:
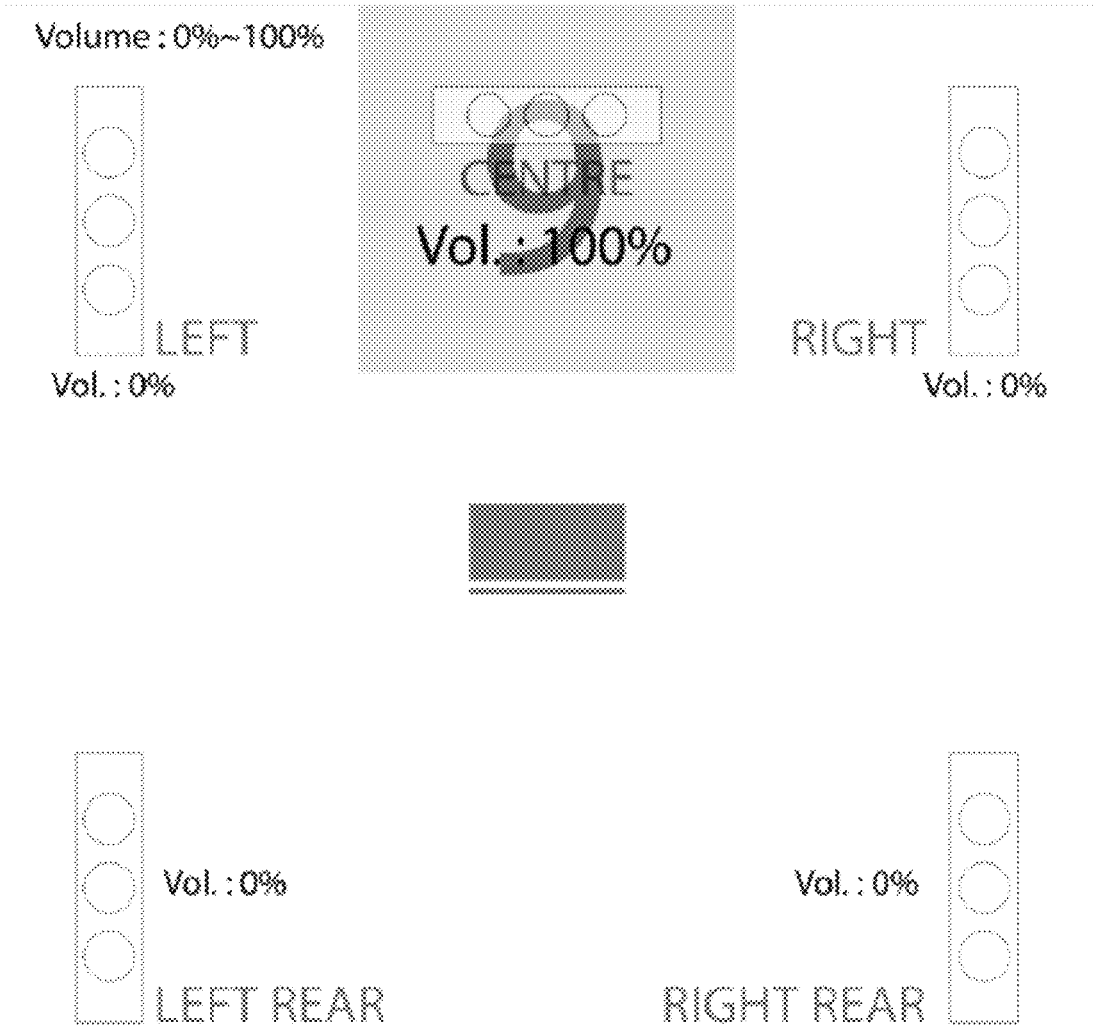

FIG. 4 shows a specific structure of each loudspeaker box in the acoustic space. Each loudspeaker box includes a treble loudspeaker (111, 121, 131, 141, 151), an alto loudspeaker (112, 122, 132, 142, 152), and a bass loudspeaker (113, 123, 133, 143, 153); it not only needs to determine which loudspeaker box plays each of the sound track elements, but also needs to determine which loudspeaker in which loudspeaker box plays each of the sound track elements.

FIG. 5 to FIG. 13 show all acoustic playback positions of nine elements of one sound track in an acoustic space of a nine-patch form.

Figure 14:
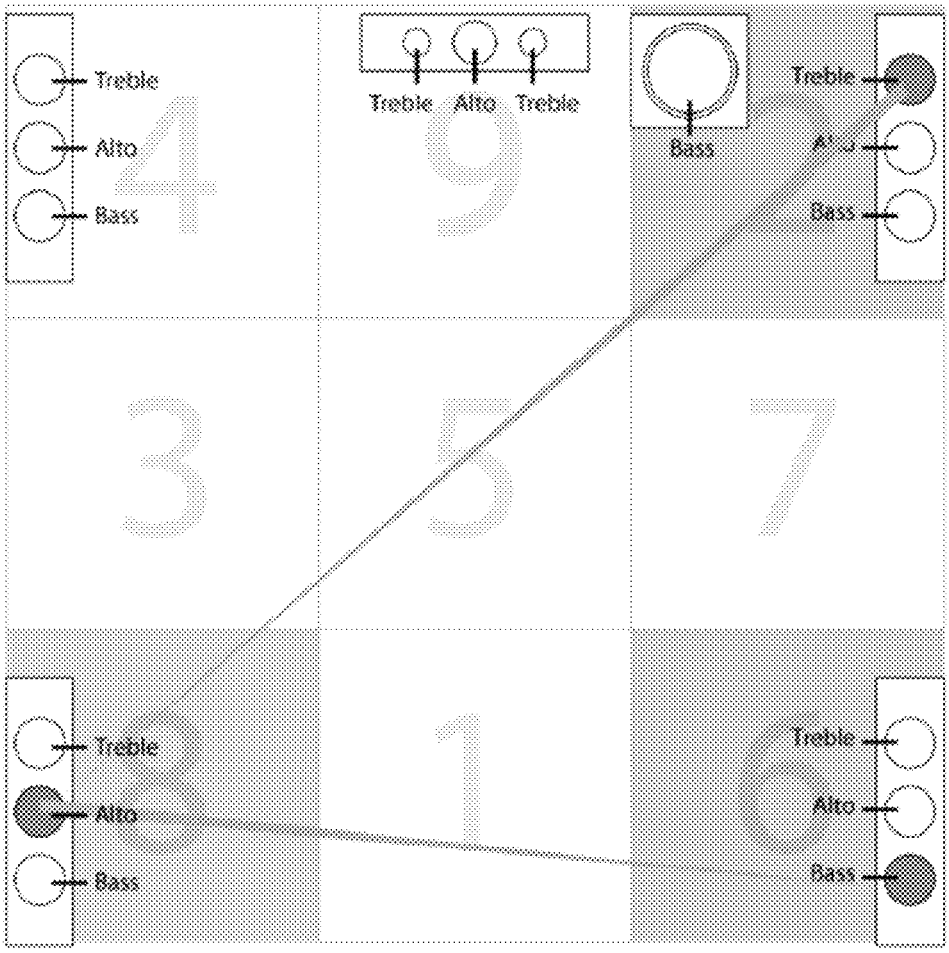
FIG. 14 shows hopping positions of three sound track elements ASU.

FIG. 14 shows hopping positions of three sound track elements ASU, where element A is played by a treble loudspeaker of the right loudspeaker box at position 2, element S is played by an alto loudspeaker of the left-rear loudspeaker box at position 8, and element U is played by a bass loudspeaker of the right-rear loudspeaker box at position 6. More sound track elements may be played at predetermined acoustic positions in the acoustic space as required. This is the 9D panoramic audio mixing technology of the present application, in which each sound track element of each sound track is placed at a predetermined acoustic position in a predetermined acoustic space based on a particular sketch, thereby achieving a mysterious audio mixing effect.

The 9D panoramic audio mixing technology is an audio mixing method generated according to Chinese I Ching, Hetu, Luoshu, and theories of traditional Chinese medicine in Huangdi Neijing, which reconstructs a relationship between a music volume and a sound stage distance of 5.1 or more channels by using a unique sound sketch and audio-video editing means to edit 100 to 600 multichannel sound tracks by means of cutting, twisting, and collage, so as to implement balanced outputs in all loudspeaker boxes of 5.1 or more channels, thereby making a brand new listening range standard. These range standards are made into music positioning modules that are provided for professional mixing engineers and home listeners as an index for correcting 5.1 equipment. When all studio musical works and 5.1 equipment standards of home listeners are corrected, a "correct" panoramic sound sketch and recommended volume values can be acquired.

This is a dedicated panoramic surround audio and video positioning standard for arranging, recording, editing, and mixing multichannel music or music products of films and a solution to a panoramic digital audio-video production process.

Figure 15:
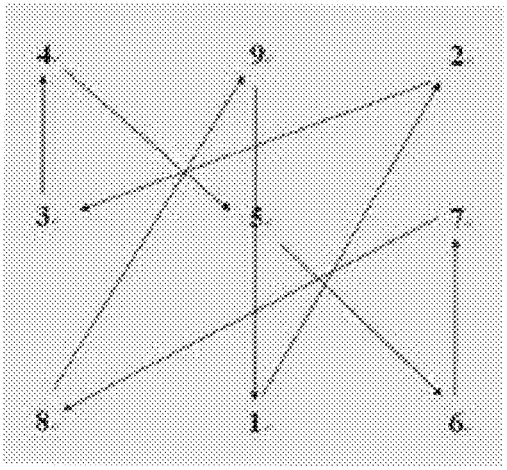
FIG. 15 and FIG. 16 show two different panoramic sound sketches.
Figure 16:
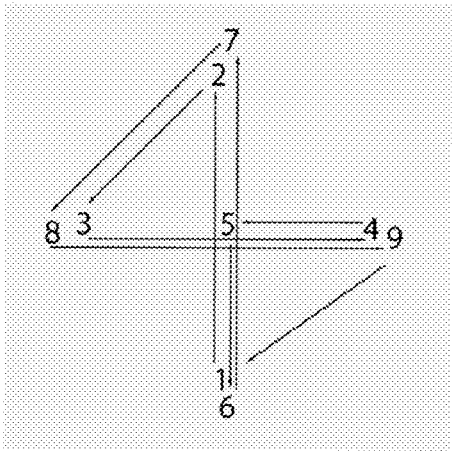
Figure 17:
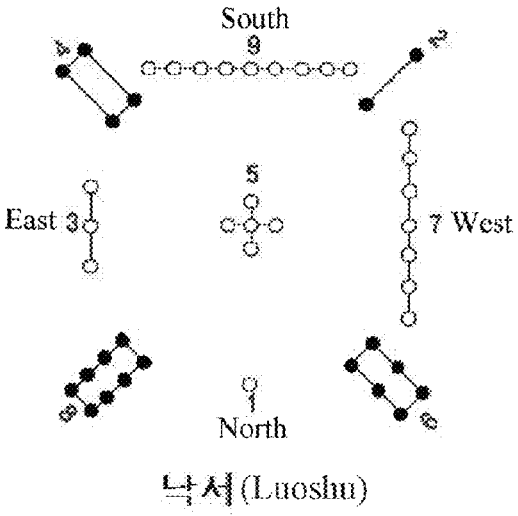
FIG. 17 to FIG. 20 show other four different panoramic sound sketches.
Figure 18:
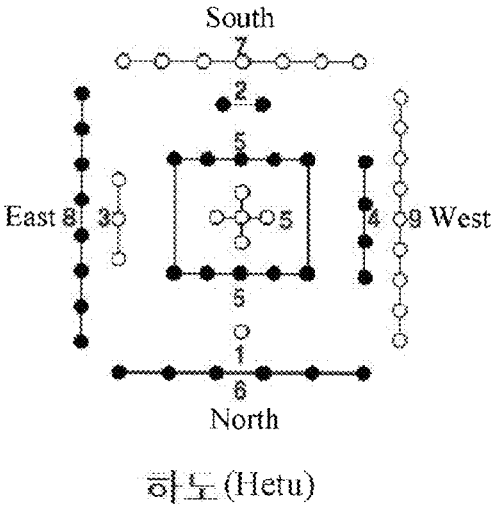
Figure 19:
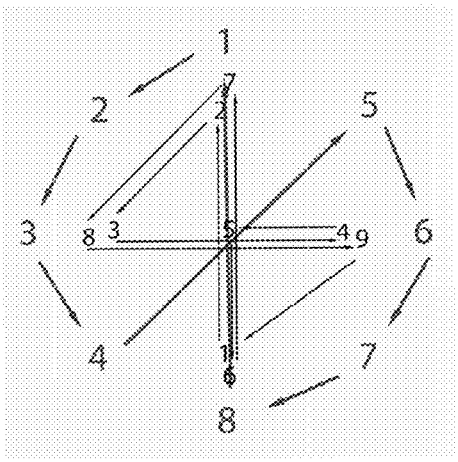
Figure 20:
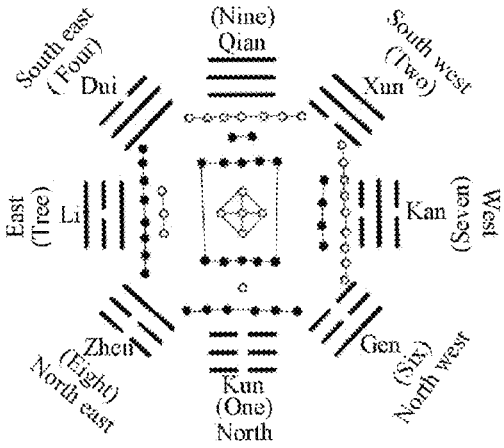

FIG. 15 and FIG. 16 show two different panoramic sound sketches, where sound track elements may be played at corresponding acoustic positions according to a sequence from 1 to 9 shown in the figure, thereby implementing hopping of sound track elements in a 3D stereo music space.

FIG. 17 to FIG. 20 show other four different panoramic sound sketches, including traditional Chinese Luoshu, Hetu, and eight-trigram, and predetermined acoustic positions of sound track elements in an acoustic space are defined according to the sketch, where sound track elements can be played at corresponding acoustic positions according to a sequence from 1 to 9 shown in the figure, thereby implementing hopping of sound track elements in a 3D stereo music space.

Industrial Standard

In use of a panoramic surround loudspeaker box, first of all, the monitoring volume and position of each amplifier need to be corrected, however, each CD has a different recording level, and no panoramic sound sketch standard or volume standard has been formulated in the industry. In specific implementation, relative quantity adjustment may be performed according to a comparison between sound tracks. During audio mixing, a large quantity of and a great variety of sound tracks are involved. There are as many as hundreds of sound tracks, and moreover, types of the sound tracks include human voices, music, sound effects, and so on. Sound track elements of each sound track need to be arranged at acoustic positions in an acoustic space according to the foregoing description, and moreover, parameters such as volume, frequency, and delay of each sound track element need to be determined. For example, on a same human voice sound track, frequency conversion may be performed on sound track element A to produce sound track elements of different frequencies, and a sound track element may be played for different predetermined numbers of times, to produce different delays, for example, a playback time of an original signal of sound track element A is 1 second, and by playing the original signal of sound track element A three times, the sound track element is delayed 3 seconds. In a word, adjustment of different audio parameters may be performed while an acoustic position of a sound track element is arranged.

Audio Mixing Setting 9D audio mixing is an innovative audio processing technology, which uses the latest audio mixing technology to present vivid "panoramic audio-video" of original multi-track recording. It provides an audio mixing workflow solution, and helps complete volume correction, audio creation, conversion, and multi-track audio mixing. It is designed dedicatedly for fixed wires, satellites, IPTV, terrestrial television, broadcast, and post production organizations. 9D audio mixing can perform encoding, decoding, conversion, and transcoding processing on bit streams of Dolby digital, Dolby digital+, Dolby Pulse, Dolby Atmos, and Dolby E formats; besides, it also supports PCM, MPEG-1 LII, AAC, HE AAC, and HE AAC v.2.

9D Recording Setting 9D audio mixing requires original multi-track recording, and after processing using the audio mixing technology, holographic panoramic vivid audio-video is presented through the latest technology.

With the arrival of the HD era, films/TV programs have a higher requirement on audio quality, which inevitably increases the workload of audio production departments of TV stations greatly. How to improve audio production efficiency of programs has become an urgent task to be solved. The following is an audio production process of the present application:

9D panoramic digital audio and video production process

1) Audio production service mode

First, determine that an audio-video product is of original multi-track recording, and perform audio production at an audio workstation (the audio production herein excludes simple processing such as cutting and level adjustment, but specifically refers to complicated processing such as dubbing, foley, and audio mixing).

Figure 21:
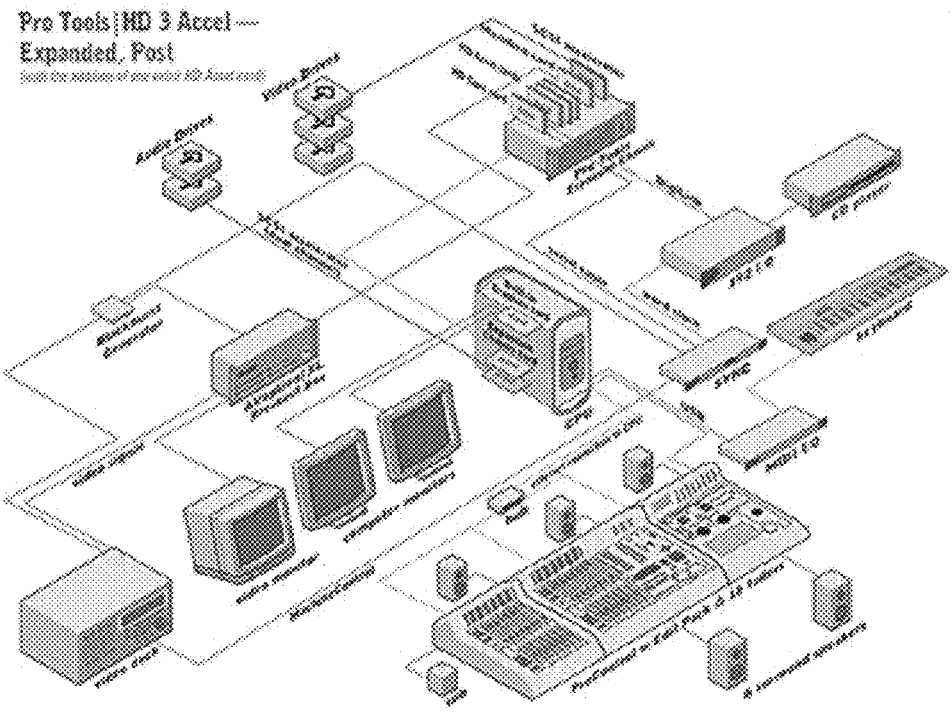
FIG. 21 shows a structural diagram of a multichannel workstation system according to the present application.

2) Complete audio and video production at a multichannel workstation (for example, a workstation with the structure shown in FIG. 21)

At present, in most TV programs made overseas and in China, there is no dedicated processing for audio, and only audio editing, dubbing, and simple level processing are performed. Many defects of sounds recoded in an early stage are neglected, for example, wind noise, background noise, noise of spraying microphone, current interference noise and the like cannot be eliminated, which affects the intelligibility of a program. An excessive large difference in program level values or even a peak clipping distortion happens occasionally (all TV audiences have the following experience: you are sitting on a couch and changing TV channels, and almost jump out of the couch when hearing the loud sound of a certain channel; then you turn down the volume immediately, unfortunately, the sound volume of a next channel is as low as a mosquito; it turns out that the volume control button is the first button destroyed except the channel switching button). This situation occurs because on one hand, emphasis on audio production is insufficient, and on the other hand, an audio function of current mainstream NLE workstations is poor. Video providers do not pay enough attention to audio, and most NLE products only have simple level adjustment and channel allocation functions, which are insufficient for audio production. Accordingly, the concept of a 9D audio mixing and audio/video integrated workstation comes into being. Main features of the workstation are as follows:

Audio Quality

Digital audio has advantages in terms of storage and transmission, but the sound quality of the digital audio can only be as close to that of analog audio as possible. Sampling and quantization during digitalization inevitably causes the loss of sound quality, and engineers try every method to reduce such loss, where a sampling frequency and a quantization bit number are the most important indexes. In the HDTV China National Standard, studio digital audio should reach 24 bit/48 kHz, while audio of an HD digital recording studio reaches as high as 24 bit/96 kHz. Audio processing precision of an audio/video integrated workstation should at least meet this standard. In addition, it is inevitable to perform special effect processing and synthesis on audio materials during production, to avoid affecting an iterative synthesis effect, the precision of internal special effect processing should further be higher than 24 bits.

Digital Full Scale Level

It is specified in the national broadcast, film, and television industrial standard that, a full scale level of a digital audio device should be +24 dBu, that is, a steady-state reference signal −20 dB FS is equivalent to a normal working level of an audio program signal. Due to historical reasons, a lot of +22 dBu devices are still used currently and this situation may not change in a long period of time, however, when selecting a new device model, we still expect it to meet the national standard. This standard should not only be reflected at input and output ports of the audio/video integrated workstation, but also be used as basic parameters of software digital audio meters and digital audio special effects. If we fail to notice this, we cannot control digital levels, let alone unify levels of output programs.

Synchronization

A PAL or 1080/50i HD system has 25 frames of images per second, and it is not difficult to implement editing accurate to frame. However, processing of audio is accurate to a sampling point level; for example, interference noise due to infirm wire connections or other causes affects a range of 10 to 20 sampling points in a case of digital audio sampled with 24/48, and to eliminate the interference noise, the precision of audio editing should use sampling point as a unit.

In this example, each video frame corresponds to 48000/25 audio sampling points; therefore, during internal processing of software, audio-video alignment needs to be performed at intervals of 48000/25 sampling points, to avoid asynchronous sound and image caused by an error accumulated over a long period of time. If a 96 kHz or higher sampling rate is used, the software should be capable of automatically determine an interval time for audio-video alignment, to ensure that the synchronization processing is accurate to sampling point.

Dynamic Adjustment

The special effect processing on an image can be performed based on a key frame, where the image presents state a at point A, and presents state b at point B. As long as the four factors are determined, all movement manners of the image in this period of time are defined. This is a static adjustment process. However, audio editing cannot make decisions by using a key frame or a key point, and the editing process of most audio needs to be implemented dynamically. It is unimaginable to use only one or two key points to eliminate all noise during a period of time. Actually, in all audio adjustments, the frequency, amplitude, and phase need to be adjusted in real time, and by using the 9D audio mixing technology, an operator can modify an adjustment scheme while monitoring the effect. Therefore, the audio/video integrated workstation needs to provide a dynamic editing means for audio, and all adjustments on special effects are based on an effected detected rather than a key point. At present, sound effect production of TV programs mainly lies in the following aspects:

(1) Remedy sound defects in materials shot in an early stage, for example, eliminate ambient noise, wind noise, and current interference; common effects include De-Noise, De-Click, High-Pass, Low-Pass, Band-Pass, Graphic EQ, and the like.

(2) Process audio recording materials. Time Stretch is a commonly used tool, which performs speed variation processing, that is, time-scaling without pitch-scaling, on excessively short or long voice-over in a certain range; in addition, for some interviewees whose identities need to be protected (such as juveniles and whistleblowers), processing such as Tone-Pitch, Paramitric EQ, and Delay may be performed so that the sound is not easily identified.

Surround Sound Processing Capability

Precisely positioned surround audio-video, multi-track audio mixing, and a multichannel editing mode can be implemented by using the 9D audio mixing technology and HD audio/video integrated production workstation. A production platform needs to satisfy the following two requirements: first, it needs to support a 6-channel input/output capability or a higher capability; and second, it needs to provide an audio-video positioning tool. A sound source may be randomly allocated to one or more channels, and the displacement and spread of the sound source are fully adjustable and can be recorded automatically; this is the complete panoramic surround sound production.

The 9D audio mixing technology and HD audio/video integrated production platform has the following features:

24 bit/48 kHz or higher audio sampling and 32 bit or higher internal processing capability Input/output and monitoring both satisfy the full scale level standard of +24 dBu Audio-video synchronization based on sampling point level Full dynamic effect processing Surround audio-video positioning function Such an audio/video integrated workstation can basically accomplish audio/video production of news programs of TV stations. For film and art programs, we need a "super workstation", in which 9D software is used to exchange engineer files between NLE and DAW.

Music Therapy

Huangdi Neijing, as one of the four major medical works of the traditional Chinese medicine theories, mainly studies traditional Chinese medicine theories such as human physiology, pathology, and therapeutic principles. Content of theories such as "Yin and yang", "Zang and fu", and "meridian" in Huangdi Neijing analyzes and summarizes actual applications of related theories about using music in "emotional psychotherapy" and "physiotherapy", and lists therapeutic methods of using different music forms according to different causes of disease. Content of the music treatment specifically may be divided into three parts, that is, sound therapy, musical tone therapy, and music therapy. The "sound therapy" is illustrated from three aspects, that is, the five notes of traditional Chinese music, harmonious pitches of the five internal organs, and the relationship between five sounds and the five notes of traditional Chinese music as well as the six bamboo pitch pipes among the twelve; the "musical tone therapy" is the key content in the scope of music treatment, and analyzes musical tones, the five notes of traditional Chinese music, the six bamboo pitch pipes among the twelve, the twelve-tone temperament, the twenty-five tones, the twenty-five tones score and other score forms, binaural therapy, and content in other aspects.

The 9D panoramic audio mixing technology is a dedicated surround audio and video positioning standard for arranging, recording, editing, and mixing multichannel music or music products of films and a solution to an panoramic digital audio and video production process.

The 9D develops the traditional Chinese music therapy theory to be an panoramic audio processing technology.

Precisely positioned surround audio-video, multi-track audio mixing, and a multichannel editing mode can be implemented by using the 9D audio mixing technology and HD audio/video integrated production workstation, thereby satisfying the requirement of modern TV station and film digital production.

Figure 22:
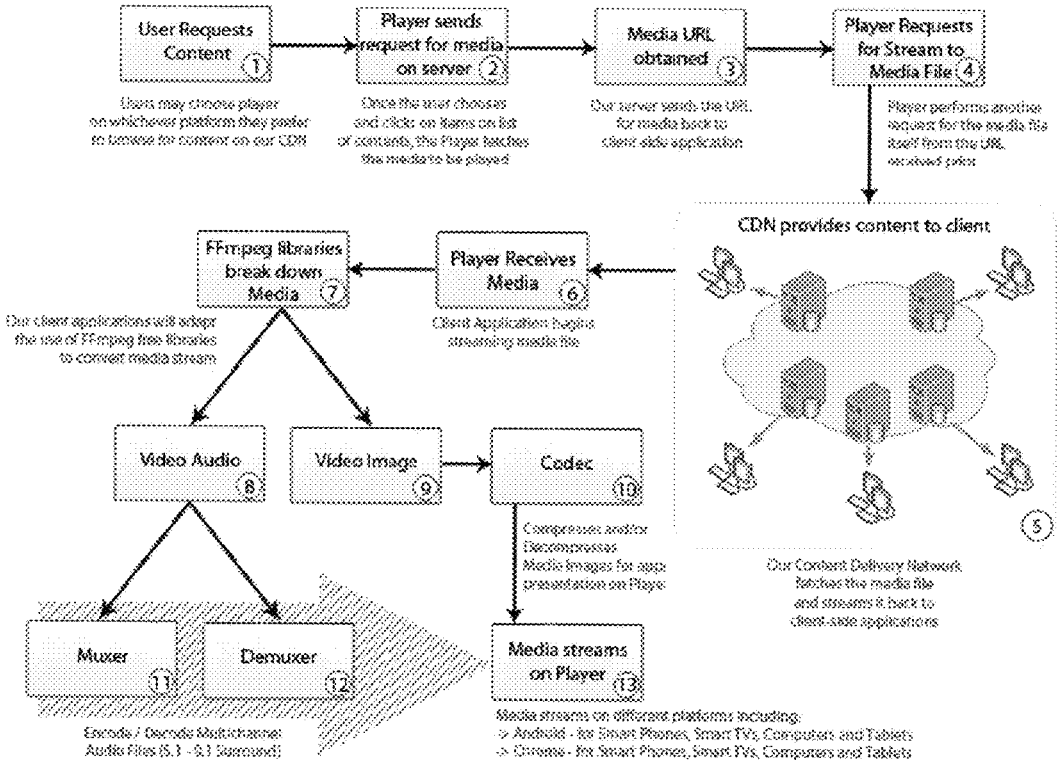
FIG. 22 shows a processing flowchart of a system according to the present application.
Figure 23:
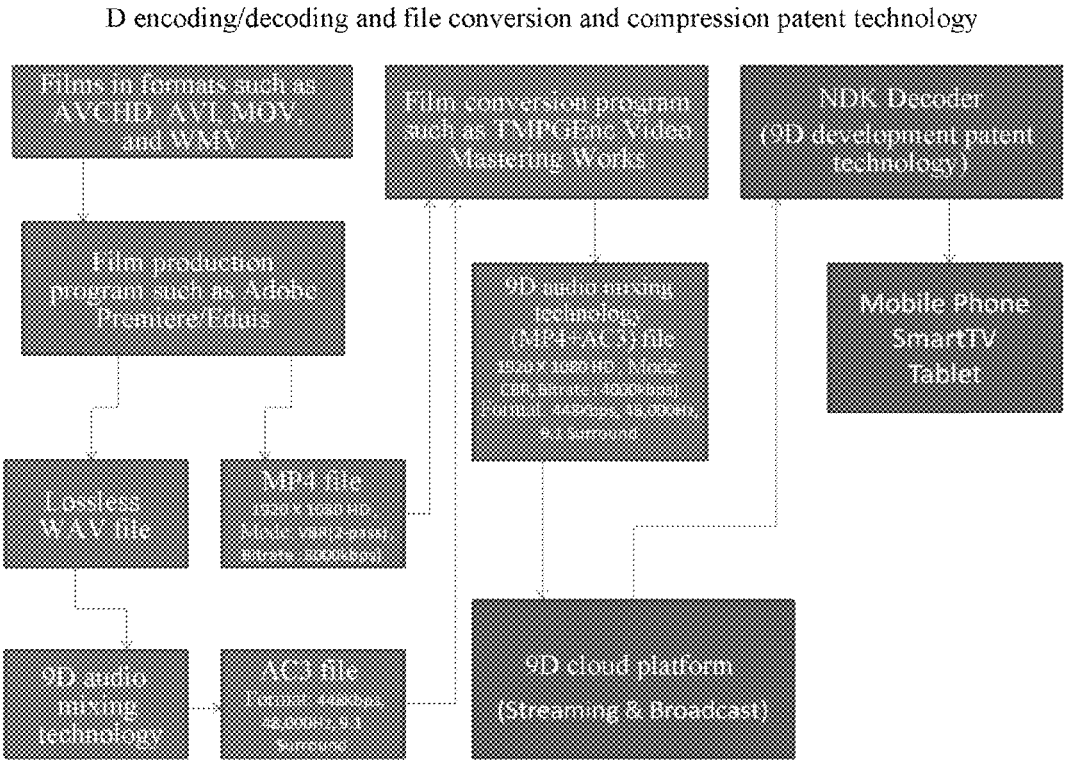
FIG. 23 to FIG. 26 show structural diagrams of four encoding/decoding and file conversion and compression forms according to the present application.
Figure 24:
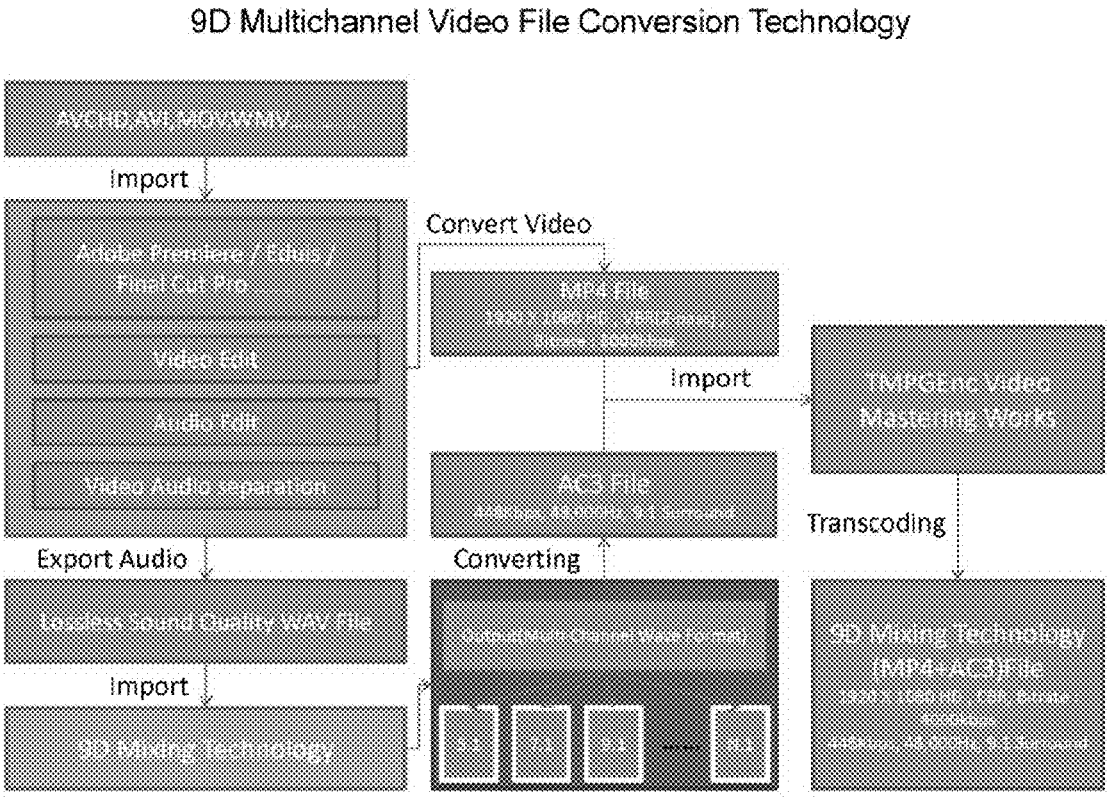
Figure 25:
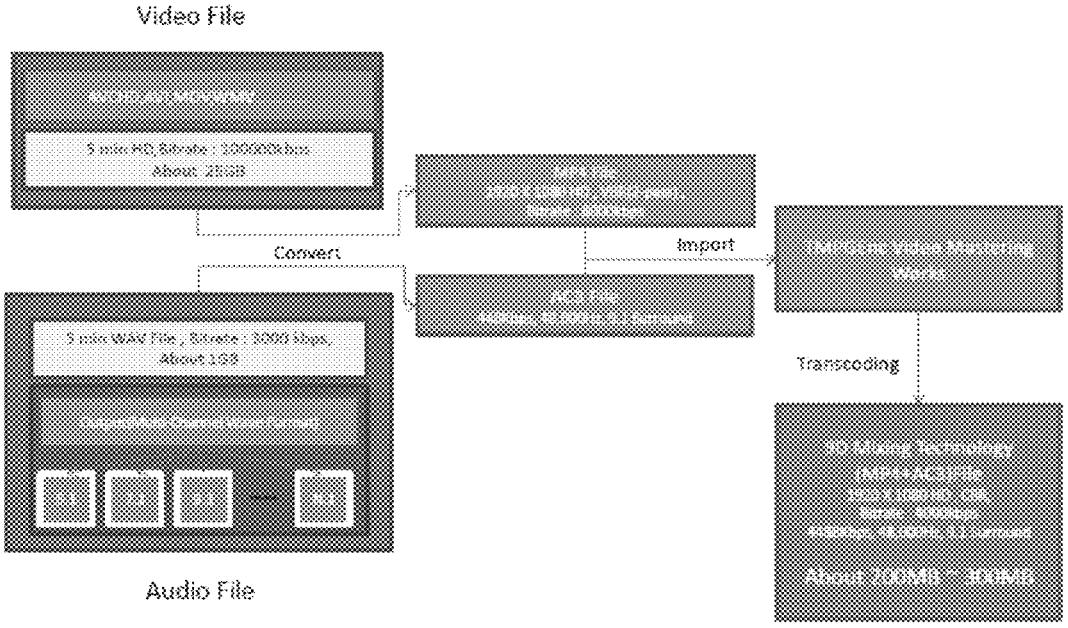
Figure 26:
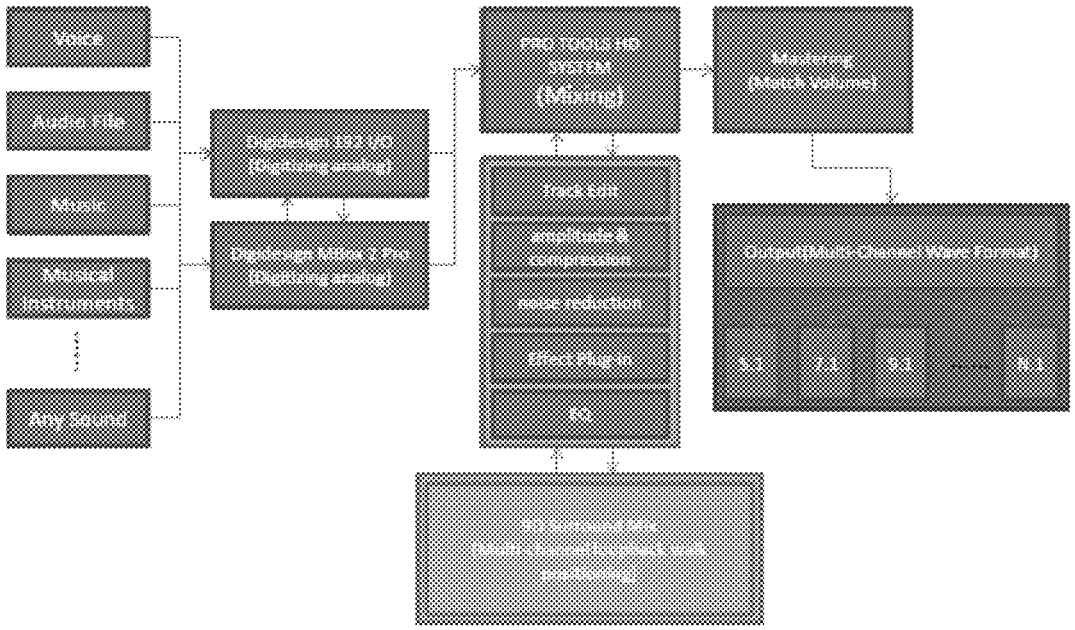

FIG. 22 is a processing flowchart of a system according to the present application. The audio mixing method and system of the present application may be implemented based on a computing apparatus 20 as shown in FIG. 1, and the computing apparatus 20 is, for example, a personal computer (PC), and the PC includes a desktop computer or a notebook computer running a Windows or an OS X operating system; alternatively, the audio mixing method and system of the present application are executed by a larger server 20, where the server 20 includes a central processing device for executing specific instructions and a data storage device such as a blade-type storage array, and thus has mass storage space, thereby capable of undertaking a large quantity of sound track storage tasks. The central processing device is configured to execute specific instructions, thereby executing various system-related operations. The finished audio mixing work can also be released to a cloud-end server, for users to download. Users can download the work by using their own intelligent devices, where the intelligent device includes a smart phone, a tablet computer, and the like running an IOS system or an Android system. The cloud-end server supports wired access or wireless access; the wired or wireless access includes: WIFI/2G/3G/4G mobile network access, satellite communications access, or wireless radio communications access.

Referring to FIG. 23 to FIG. 26, after the audio mixing is completed, the present application further uses a specific compression technology to process the final audio/video work:

(1) First, use a film production program such as Adobe Premiere/Eduis to convert an edited clip into an MP4 file (where the format is as follows: the resolution is 1920*1080 HD, and the mode is VBR(2-pass), and the bit rate is 8000 kbps).

(2) Convert the sound of the edited clip into a lossless WAV file, and arrange sound tracks by using the 9D audio mixing technology.

(3) Convert the WAV file in which the sound tracks are arranged using the 9D audio mixing technology into an AC3 file (where the format is as follows: 448 Kbps, 48,000 Hz, and 9.1 Surround).

(4) Finally, use a film conversion program such as TMPGEnc Video Mastering Works, to convert the file into a 9D audio mixing technology (MP4+AC3) file, where the format of the film is as follows: the resolution is 1920*1080 HD, the mode is constant bit rate (CBR), the bit rate is 4000 kbps, and the sound mode is CBR, 448 Kbps, 48,000 Hz, and 9.1 Surround; through the 9D stream cloud platform, transmit the audio and video to a Mobile Phone/Smart TV/Tablet Mobile Phone/Smart TV/Tablet, and decode the audio and video by using a NDK Decoder (9D developed patent technology), thereby implementing high definition and 9.1 Surround.

The following describes the musical perception of "9D music".

The world we live in is commonly known to consist of length, width and height, collectively referred to as the three dimensions. The Superstring Theory holds: if the three-dimension space we live in is the first universal space, then three three-dimension spaces will consist a nine-dimension space, namely, the space of triple universe. The nine-dimension space is featured that it is balanced and symmetrical in the whole. If time is taken to measure the commonality before and after an event, then the nine-dimension space can be regarded as three three-dimension spaces and a shared one-dimension time, together they are called the space-time structure of triple universe. With triple universe structure, the universe in our eyes is only one third of the whole universe and the rest two thirds is beyond our sight.

Music is commonly known to be derived from single channel to double channels. Stereo music with different surround effects can be produced by different audio sources. This is what we know as the three-dimension musical space. Sounds are divided into left, right, forward, backward, upper and lower directions. Three three-dimension musical spaces consist a nine-dimension musical space, namely, the space of triple musical universe. If musical notes and sound wave changes (time) are turned into music (mixture of human voice and instrumental sounds), then the triple three-dimension musical space can be produced. Music in nine-dimensional field surmounts the fixed sound stage. There every note moves and penetrates the three-dimension space and every sound wave convolutes so as to form multi-ultrasonic audio channel changes through setting up different sound sources and sound stages.

Now as we already have the triple musical universe structure, the stereo music (three-dimension music) as we usually known is actually one third of the whole musical field and the rest two thirds is left unused and wasted.

In the "9D multi-ultrasonic mixing technology" of the present application, application of the mixing software turns musical notes, sound waves and audio frequency into brand new musical perception through collage, arrangement, editing and twisting, which is known as "9D music".

With every note moving, such innovative multi-ultrasonic mixing has never appeared in any works in the whole world. The development of "9D music" not only expands the space-time concept of musical work but also brings the subtle responses from interaction between the mixing effect and the audiences' body frequency, which introduces brand new musical perception and 5.1 loudspeaker positioning into the music market.

The present application applies "Traditional Chinese Medicine Music Therapy" in "9D music" based on the theories in I Ching, adopts the innovative concept of massaging in the neuron by using the sounds of running clock gear and hands, 84 beats per minute healthy heartbeats, 36 jumping drum beats and surrounded hurrah as the sound effect, so as to produce the natural resonance between the audiences' visceral and mental sensations and the musical notes when listening to 9D music, which will coordinate the body condition and the musical notes so as to improve their health.

"9D music" surmounts the fixed sound stage, every note of it can move and every sound wave can twist and convolute. By using different positions of the sound sources and different sound stage setting, we can form multiple, ultrasonic and ever-changing musical works.

"9D" refers to nine dimensions and symbolizes the nine basic dimensions of music world. "Multi-" refers to multiplication, ensemble and compound chords. "Ultrasonic mixing" refers to that one or more ultrasonic waves are added in most of the 9D musical works to wake up the consciousness of human body's healthy cells.

"9D" music has the following characteristics:

Musical products specially recorded for 5.1 or above HiFi system.

All 9D musical products attach importance to the musicality, riveting performance and whole balancing (Superstring Theory).

All 9D musical works are filled with strong film sense, especially the continuity of mobile sounds; such continuity is presented microcosmically in a music album.

9D musical works focus on how to present a nine-dimensional musical space and puts a lot in the penetrability and its subtle interactions with audiences' bodies.

Every piece of 9D musical works is musical structure of the same frequency, and the sounds are recorded into the nine-dimensional channel according the concept of the present application.

The sound sketch of every piece of 9D musical works is drawn out based according to the present application, and the precise calculation of mobile sound effect will surprise audience in psychoacoustics and physical levels.

Every piece of 9D musical works is processed from multi-track. Every song is mixed in over one hundred to two hundred tracks and allocated in six to nine sound track outputs, so the sound is tightly connected and different effects can be produced in different stereo combination.

Every piece of 9D musical works covers the low frequency or the declining extent of ultra-low frequency during production, so no matter what the sound stage structure of the house is, as long as 5.1 stereo is balanced, the optimal effect can be heard.

Audio CDs on current market are of double-channel for playback with two amplifiers. The so-called stereo sound is actually two simulated rear complementary sounds by using distance sounds in the background. Even the 5.1 DVD of on-site recording of the concert, the major voice is only set at the front amplifier and the sounds of musical instruments are output from fixed sound sources. Only few complementary sounds and applause which are added by sound mixer are allocated to the rear surround loop. It is absolutely not comparable with the detailed sound effects and mobile surround effects of human voice which are designed and produced by using the sound sketch drawn according to the present application In the sound sketch of the present application, every sound track has its own sound source for high quality surround effect, and therefore, every song is of distinguished ultra-stereo surround effect. The human voices are produced in different fixed points and surround around 5 to 8 amplifiers.

Human voices in current CDs are output from the front amplifier, and the rear human voices are only for complementary or chords. Moreover, the sounds of the musical instruments in most of the current CDs are output in single direction and no surround effect is set up when mixing, most of and them are split digitally only by the main machine.

During playback with 5.1 amplifier, not all sound stages of 9D music burst out at the same time; instead, every output frequency band has real track interspaces (namely, every frequency band has solid space), thus, the music is played in six amplifiers from six frequency bands synchronously, to produce an ultra-stereo sound stage.

The 9D audio mixing of the present application includes design and production for different aspects of the music:

Provide song context ideas, sound sketch design, stereo sound stage design for triple 360-degree continuity, sound source positioning, and musical instrument and special effect combination design, produce the whole balancing effect, and so on.

Computer and software operation, sound track connection, sound source setting, creating of sense of harmony, triple 360-degree continuity, setup of mastering output frequency band, and so on.

Monitoring the harmonious sense of the tracks, accuracy of sound source positioning, smoothness of every twisted frequency, efficiency of mobile sound effects and the forming of ultra-stereo sound stage, and so on.

Seeking a suitable special sound effect from over 30 thousand sound effect files to adjust and edit the sound effects to meet the demand of the whole song.

Based on the audio mixing technology of the present application, it is possible to implement various subtle acoustic effects, for example, a sound effect of a bullet twisting forward. At an early stage, 5.1 players always adjust the amplifier's parameters and move the amplifier to maintain a bullet route, no matter the film sound designer adds the sound effect of the bullet twisting forward or not, they take it for granted that they can hear the bullet sound after turning up the parameters. As more and more output channels of home visual equipment, HiFi and multimedia computer modify the defects of the phase of amplifier, 9D music can easily add refined bullet twisting sound in the multi-dimensional mixing structure, and this can be heard by most people. For 9D music mixing engineering, we record several human voices or musical instrument sounds in several different tunes and mix them together with repeated tests to produce the music with the strongest film sense.

The distance between time and space is not completely controlled in traditional mixing approaches and this may not meet the demands of the high-level players in such an era filled with HiFi system and computer technologies.

The 9D music mixing approach of the present application distributes over 100 to 200 channels of musical instrument sounds, special sound tracks and principle human voice to 6 to 9 outputs and sets up a stereo sound stage for every output. When a piece of work is played in 6 amplifiers, the stereo sound stage of every amplifier transfers the ultra-stereo sound stage together with the other 5 to 6 amplifiers. With the length, width and height of sound stage, it accomplishes the unique triple 360-degree sound field of 9D music, so the directivity and coverage of the sound stage stands out.

In the past, we enjoyed music from single direction playback of the left and right side amplifiers. This kind of music has no variation or level; the sound just simply plays flatly and directly in front of audience. Now, the present application can bring the musical perception to a brand new trend. All of us can image about the sound effect of a film: an airplane takes off right in front of you, the engine rumbles, and it happens to be raining heavily, a bullet flies by you. The feeling of being on the scene brought about by the blockbuster-like sound effect, and the authenticity of engine, rain and bullet are the effect accomplished by the audio mixing technology of the present application. With the 5.1 or above loudspeaker system, the brain and even body of the audience is surrounded by music. When the audiences enjoy the songs in their seats sounded by 5.1 amplifiers, they will feel like being immersed in the chord world weaved by musical notes and waves and will create images in their minds, as if they are sitting on the sea and watching hovering seagulls or, on the hustling street, watching luxury vehicles rocketing by. This makes the audiences delighted.

Five-line staff of "9D music" is three-dimensional and interactive pipelines for inputting and outputting musical notes. In the present application, "dots", "lines" and "planes" on the staff are integrated to form a multidimensional space. Even in arrangement design of sound track elements, we will intentionally extend the tremolo and control the musical note strength and at the same time add diverse light waves and laser frequency to stimulate the contact point of audiences nerve cells, activate their brain cell elements and balance the nerve cell system so as to raise the resonance of the blood. The nerves that control brain voltage can be restructured and activated. The music obtained by means of processing with the audio mixing technology of the present invention can remain the freshness every time you enjoy it. It brings the audiences wonderful and dreamful feelings with respect to the interaction between the music and body, which does not only expand the space-time concept of music world but also produce subtle responses from the interactions between the mixing music and body frequency. It initiates a new trend for enjoying music.

By using the foregoing 5.1 channel system as an example, 5.1 channel music production consists of the following steps:

First, find a Dolby certified sound control room. Commonly, the room shall be effective in sound absorption and spacious enough to accommodate a set of recording and mixing equipment and audiences. Besides having the normal standard of a common sound control room, a Dolby certified sound control room shall be equipped with a workstation which can collect and edit sounds as well as a sound monitor environment in line with 5.1 channel system.

Secondly, determine the equipment for producing 5.1 programs, such as microphone, digital mixer supporting 5.1 channel, effect pedal producing 5.1 channel musical works and monitor speakers meeting the playback effects of 5.1 channel system. All these equipment is the basis and key elements for 5.1 channel musical work production and the quality of the equipment decides the quality of the work. We can imagine that it must be disorderly in the post-production mixing without proper pickup; or even the satisfactory program in the control room will encounter souffle or unclear sounds in other play environment without proper monitor. So it is a must to prepare a while set of equipment for producing 5.1 channel musical work before production.

After deciding the sound control room and equipment, it turns to the producer to select songs and the singers to record. 5.1 channel musical work production consists of two phases: pro-phase and post-phase. In the pre-phase of the 5.1 channel music production, single-point timed recording or multi-channel overall recording are usually applied. Single-point timed recording refers to the recording of one and another sound in different time, while multi-channel overall recording refers to the simultaneous recording of all sounds performing together with five microphones besides the sound generators. The difference between the two is that, in the single-point timed recording, the sound generators come into the workstation one by one and the sound will be treated into 5.1 channel musical works separately in the post-production phase; and in the multi-channel overall recording, five channels come into the workstation at the same time, and then the sound will be produced into 5.1 channel musical work.

Post-production for 5.1 channel musical works refers to artistic mixing of the collected sound elements in pre-phase, including decorating the sound and imposing some effects so as to enrich the 5.1 channel musical work. Thus it needs some production equipment, such as the workstation and software system for musical work production as well as additional auxiliary equipment (tens of thousands of special effect files). 5.1 channel program production usually needs surrounding equipment that can support 16 channels so as to be recorded, collected, edited and played. Take audio workstation for example, it is a must for realizing music recording and editing. During the course, additional equipment can be applied to decorate the music to achieve the best effect. The 5.1 channel program can be perfectly completed with the cooperation of surrounding equipment.

After sound elements are recorded and mixed, it comes to the most important step for 5.1 channel musical work production—coding. 5.1 channel system coding is the brief expression of Dolby Digital 5.1 and is also known as AC-3. Besides left, right principle channels, middle channels and left and right surround channels, it also has a mega bass channel. The five channels are independent of each other. The "0.1" channel among them is a specially designed mega bass channel. The six channels are coded and saved into AC-3 format. So when Dolby Digital System decodes and plays, five channels and a mega bass channel can be heard. As there are amplifiers in the front, at the back, and on the left and right, the listeners will feel like being embraced by music as if in the concert. In addition, another popular multi-channel surround coding is DTS, namely, Digital Theater System, which applies compression technology other than AC-3 to store the surround effect into DVD and a special system shall be applied during playback so that 5.1 channel hidden in DVD can be released. The major difference between DTS and Dolby Digital 5.1 lies in their "algorithm", that is, Dolby Digital 5.1 compresses the same materials to the largest extend and occupies smallest space, while DTS does not focus on the high compression strength and stores more files, and if properly handled, it is more expressive than Dolby.

When completing the 5.1 channel musical work production, we need to consider how to replay the authentic music to the largest extent. Among existing replay plans, 5.1 channel sound effect processing system is a relatively perfect solution. 5.1 channel musical works are recorded in the storage media after being coded, so the music can only be played normally with a replay system which is equipped with a digital decoding system, and this is the core of 5.1 home cinema system. 5.1 channel musical works are replayed in 6 amplifiers of the home cinema system from 6 channel signals after being decoded.

Modern music is of single-direction and flat, and even if the concert DVD is replayed with 5.1 sound effect, it only records the on-site sound effect. However, "9D" music in the present application integrates human voices, incidental music, sound effects and so on in accordance with the fixed directions, so that the same movement can produce multiple spaces during interaction. Music compiled by "9D" always changes. The changing music notes hover in the vast musical field freely as if it is an unrestrained consciousness flow. This is not what the double-track music can express. In a word, music works produced by using the audio mixing technology of the present application provides audiences with wonderful listening experience and creating a perfect sound effect.

What is claimed is:

1. An audio mixing method for audio mixing on original sound signals, comprising:

arranging a plurality of loudspeaker boxes according to predetermined positions to form a predetermined acoustic space, the predetermined acoustic space comprising a plurality of predetermined acoustic positions; and arranging, at the predetermined acoustic positions in the predetermined acoustic space, sound track elements of each sound track among one or more sound tracks based on a predetermined rule; wherein:

the predetermined acoustic space comprises nine acoustic positions divided based on a nine-patch pattern having three lines and three columns;

a left-front loudspeaker box, a centre loudspeaker box, a right-front loudspeaker box, a left-rear loudspeaker box and a right-rear loudspeaker box are separately arranged at line 1, column 1 of the nine-patch pattern, line 1, column 2 of the nine-patch pattern, line 1, column 3 of the nine-patch pattern, line 3, column 1 of the nine-patch pattern, and line 3, column 3 of the nine-patch pattern;

a first mixed acoustic effect is achieved by the left-rear loudspeaker box and the right-rear loudspeaker box with equal levels for playback to form a first virtual loudspeaker box located at line 3, column 2 in terms of acoustic perception of a listener sitting at a central position at line 2, column 2;

a second mixed acoustic effect is achieved by the left-front loudspeaker box and the left-rear loudspeaker box with equal levels for playback to form a second virtual loudspeaker box located at line 2, column 1 in terms of the acoustic perception of the listener;

a third mixed acoustic effect is achieved by the right-front loudspeaker box and the right-rear loudspeaker box with equal levels for playback to form a third virtual loudspeaker box located at line 2, column 3 in terms of the acoustic perception of the listener; and a fourth mixed acoustic effect is achieved by the left-front loudspeaker box, the centre loudspeaker box, the right-front loudspeaker box, the left-rear loudspeaker box, and the right-rear loudspeaker box with equal levels for playback to form a fourth virtual loudspeaker box in terms of the acoustic perception of the listener.

2. The audio mixing method according to claim 1, wherein each of the loudspeaker boxes comprises a treble loudspeaker, an alto loudspeaker, and a bass loudspeaker, and each of the sound track elements is determined to be played by a predetermined loudspeaker in a predetermined loudspeaker box according to the predetermined rule.

3. The audio mixing method according to claim 2, further comprising:

correcting a monitoring volume and a position of each of the loudspeaker boxes and each of the loudspeakers; and determining an audio parameter of each of the sound track elements.

4. The audio mixing method according to claim 3, wherein the audio parameter comprises: volume, frequency, and delay, and the audio mixing method further comprises: on a same sound track, changing the frequency of a given sound track element to generate sound track elements of different frequencies, or playing the given sound track element for different predetermined numbers of times to generate different delays.

5. The audio mixing method according to claim 1, further comprising: producing an audio file used for wired, satellite, IPTV, terrestrial TV, broadcast propagation media; and coding, decoding, converting, and transcoding bit streams of Dolby Digital format, Dolby Digital+ format, Dolby Pulse format, Dolby Atmos format, and Dolby E format, and making a final file support PCM, MPEG-1 LII, AAC, HE AAC, and HE AAC v.2.

6. The audio mixing method according to claim 5, further comprising:

determining a sampling frequency and a quantization bit number of audio digitalization, where a precision is 24 bit/48 kHz or higher;

determining a full scale level of digital audio equipment, dBu of the level is +24 or higher;

performing synchronization processing based on a sampling point;

adjusting a frequency, an amplitude, and a phase of the audio in real time; and remedying sound defects, comprising: eliminating ambient noise, wind noise, and current interference noise.

7. The audio mixing method according to claim 1, further comprising:

performing audio mixing processing based on sound therapy, musical tone therapy, and music therapy, and calculating a mobile sound effect based on psychoacoustics and physics, to form same-frequency music structure, the music structure producing a natural resonance between the viscera and nervous system of a listener and musical notes when the listener listens to the music; and determining a declining extent of a low frequency or an ultra-low frequency of sound during audio mixing production.

8. The audio mixing method according to claim 1, wherein the audio mixing is performed on a lossless WAV file of sound of an edited film clip; an audio-mixed sound track WAV file is converted into an AC3 file having the following format: 448 Kbps, 48,000 Hz, and 9.1 Surround; the edited film clip is converted into an MP4 file having the following format: resolution: 1920*1080 HD, mode: VBR (2-pass), and bit rate: 8000 kbps; the MP4+AC3 files are combined into a final audio and video file having the following format: resolution: 1920*1080 HD, mode: constant bit rate (CBR), bit rate: 4000 kbps, and sound mode: CBR, 448 Kbps, 8,000 Hz, and 9.1 Surround.

9. An audio mixing system, for audio mixing on original sound signals, comprising: a computing apparatus and a plurality of loudspeaker boxes, wherein the a plurality of loudspeaker boxes are arranged according to predetermined positions to form a predetermined acoustic space; the predetermined acoustic space comprises a plurality of predetermined acoustic positions; the computing apparatus arranges, at predetermined acoustic positions in the predetermined acoustic space, sound track elements of each sound track among one or more sound tracks based on a predetermined rule; wherein:

the predetermined acoustic space comprises nine acoustic positions divided based on a nine-patch pattern having three lines and three columns;

a left-front loudspeaker box, a centre loudspeaker box, a right-front loudspeaker box, a left-rear loudspeaker box and a right-rear loudspeaker box are separately arranged at line 1, column 1 of the nine-patch pattern, line 1, column 2 of the nine-patch pattern, line 1, column 3 of the nine-patch pattern, line 3, column 1 of the nine-patch pattern, and line 3, column 3 of the nine-patch pattern;

a first mixed acoustic effect is achieved by the left-rear loudspeaker box and the right-rear loudspeaker box with equal levels for playback to form a first virtual loudspeaker box located at line 3, column 2 in terms of acoustic perception of a listener sitting at a central position at line 2, column 2;

a second mixed acoustic effect is achieved by the left-front loudspeaker box and the left-rear loudspeaker box with equal levels for playback to form a second virtual loudspeaker box located at line 2, column 1 in terms of the acoustic perception of the listener;

a third mixed acoustic effect is achieved by the right-front loudspeaker box and the right-rear loudspeaker box with equal levels for playback to form a third virtual loudspeaker box located at line 2, column 3 in terms of the acoustic perception of the listener; and a fourth mixed acoustic effect is achieved by the left-front loudspeaker box, the centre loudspeaker box, the right-front loudspeaker box, the left-rear loudspeaker box, and the right-rear loudspeaker box with equal levels for playback to form a fourth virtual loudspeaker box in terms of the acoustic perception of the listener.

* * * * *